US007396246B2

(12) United States Patent
Okada et al.

(10) Patent No.: US 7,396,246 B2
(45) Date of Patent: Jul. 8, 2008

(54) ELECTRICAL CONNECTOR

(75) Inventors: Akira Okada, Aichi (JP); Ryuchi Nagai, Aichi (JP); Yuuchi Yamanouchi, Aichi (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 0 days.

(21) Appl. No.: 11/692,478

(22) Filed: Mar. 28, 2007

(65) Prior Publication Data

US 2007/0232099 A1 Oct. 4, 2007

(30) Foreign Application Priority Data

Mar. 28, 2006 (JP) ..... 2006-088880

(51) Int. Cl.
*H01R 13/64* (2006.01)

(52) U.S. Cl. ..... 439/248; 439/357

(58) Field of Classification Search ..... 439/247, 439/248, 353, 357, 358, 598
See application file for complete search history.

(56) References Cited

U.S. PATENT DOCUMENTS 5,788,522 A * 8/1998 Kameyama ..... 439/248
6,217,358 B1 * 4/2001 Norizuki et al. ..... 439/247
6,315,590 B1 * 11/2001 Grois et al. ..... 439/248
6,659,788 B2 * 12/2003 Canuto et al. ..... 439/248
6,666,728 B2 * 12/2003 Tachi et al. ..... 439/701

FOREIGN PATENT DOCUMENTS

JP 2002-246106 8/2002

* cited by examiner

*Primary Examiner*—Thanh-Tam T Le
(74) *Attorney, Agent, or Firm*—Barley Synder LLC

(57) ABSTRACT

A connector device includes a circuit unit having a first connector provided with a plurality of contacts. The circuit unit is moveable between a mating position and a final mating position. An electrical connector has a cover member and a second connector provided with a plurality of contacts that is arranged in the cover member. The cover member has a first connector housing receiving recess that receives the first connector. At least one locking projection locks the second connector in the cover member when the circuit unit is in the mating position. At least one lock release projection unlocks the second connector when the first connector is moved from the mating position to the final mating position. The contacts of the first connector are electrically connected to the contacts of the second connector in the mating position and the final mating position.

12 Claims, 33 Drawing Sheets

ELECTRICAL CONNECTOR

CROSS-REFERENCE TO RELATED APPLICATIONS

This application claims the benefit of the filing date under 35 U.S.C. § 119(a)-(d) of Japanese Patent Application No. 2006-088880, filed Mar. 28, 2006.

FIELD OF THE INVENTION

The invention relates to a connector device comprising a circuit unit that mates with an electrical connector wherein the circuit unit includes a first connector provided with a plurality of contacts and the electrical connector includes a cover member and a second connector provided with a plurality of contacts that is arranged in the cover member.

BACKGROUND

It is common for connection failure to occur due to vibration when a pair of electrical connectors is placed in a half-mated state, for example, in locations where a hand cannot be inserted to mate the electrical connectors or in locations where the mating position of the electrical connectors cannot be visually checked. This problem is particularly prominent in automobile applications where a hand can not typically be inserted to mate the pair of electrical connectors because of strict space limitations.

In order to solve this problem, a connector device has been proposed which allows a blind connection to be performed between a first electrical connector and a second electrical connector in which axes of the first electrical connector and the second electrical connector are aligned simply by pushing in the first electrical connector. FIGS. 38-47C (see JP-A-2002-246106) show an example of such a connector device 101 according to the prior art. As shown in FIG. 38, the connector device 101 comprises a first electrical connector 102 having a first structural body (not shown) such as a circuit board and a second electrical connector 105 having a connector member 104 and a receptacle member 103. The second electrical connector 105 is electrically connected to the first structural body (not shown).

The first electrical connector 102 has a substantially rectangular flattened shape. As shown in FIG. 39, the first electrical connector 102 has an opening 102*a* at a front end (left end in FIG. 38) thereof. As shown in FIG. 38, lock release members 102*b* are provided on upper and lower surfaces of the first electrical connector 102 at the front end thereof. A pair of lock release ribs is provided on side surfaces of the first electrical connector 102. Each of the lock release ribs 102*d* is constructed from a pair of upper and lower ribs 102*e* that extend from a rear end of the first electrical connector 102 toward a center thereof. A projection 102*f* that protrudes outward in a semi-circular shape links front end portions of the upper and lower ribs 102*e*. Engaging windows 102*g* corresponding to the projections 102*f* of the lock release ribs 102*d* are formed in the side surfaces of the first electrical connector 102 and open into the opening 102*a*. First structural body attachment members 102*h* are provided on corners at the rear end of the first electrical connector 102.

The second electrical connector 105 comprises the receptacle member 103 and the connector member 104. The connector member 104 is accommodated in the receptacle member 103 and mates with the first electrical connector 102. The connector member 104 includes a substantially rectangular mating member 104*a* that is received in the opening 102*a* of the first electrical connector 102. A flange 104*b* is provided on a rear end (right end in FIG. 39) of the mating member 104*a*. Projections 104*f* protrude from side surfaces of the flange 104*b*. Cutouts 104*c* are formed in upper and lower central portions of the flange 104*b* and are configured for receiving the lock release members 102*b* of the first electrical connector 102. Locking members 104*d* that pass between the lock release members 102*b* protrude from upper and lower surfaces of the connector member 104 in a vicinity of the cutouts 104*c*. Locking arms 104*e* are provided on side surfaces of the mating member 104*a* and are configured to engage with the engaging windows 102*g* of the first electrical connector 102 thereby locking the first electrical connector 102 and the connector member 104.

The receptacle member 103 has a substantially rectangular shape. The receptacle member 103 is connected to a second structural body (not shown). A through-hole 103*a* for receiving the connector member 104 extends through the receptacle member 103. Elastic locking ribs 103*b* are formed in a center of upper and lower surfaces of the receptacle member 103. As shown in FIGS. 40 and 46A-47D, locking claws 103*c* protrude inward from rear ends of the elastic locking ribs 103*b*. As shown in FIGS. 39 and 47A-47C, projections 103*d* used as lock release members are provided on inner surfaces of side walls of the receptacle member 103. Attachment members 103*e* for the second structural body (not shown) are provided on lower end portions of the side walls. Cutouts 103*f* with which the projections 104*f* of the connector member 104 are locked are formed on rear surfaces of the side walls.

As shown in FIGS. 39-40, when the connector member 104 is inserted into the through-hole 103*a* from a rear end of the receptacle member 103, the locking members 104*d* of the connector member 104 press-open the elastic locking ribs 103*b* of the receptacle member 103, so that tip ends of the locking members 104*d* are engaged by the locking claws 103*c*, and the projections 104*f* of the connector member 104 engage with the cutouts 103*f* of the receptacle member 103. As a result, the connector member 104 is accommodated and held inside the through-hole 103*a* in the receptacle member 103, thus forming the second electrical connector 105.

The method of mating the first and second electrical connectors 102, 105 will now be described. As shown in FIGS. 39-40, when the first electrical connector 102 moves in a direction of arrow A, the front end of the first electrical connector 102 is inserted into the through-hole 103*a* of the receptacle member 103 of the second electrical connector 105. The locking members 104*e* of the connector member 104 are inserted into the opening 102*a* in the first electrical connector 102, as the first electrical connector 102 slides inside the through-hole 103*a*. FIGS. 41-42 show the first electrical connector 102 in a pre-mated state. As shown in FIG. 46B, in the pre-mated state, the lock release members 102*b* of the first electrical connector 102 have just made contact with the locking claws 103*c* of the receptacle member 103, the locking members 104*d* of the connector member 104 are still locked in by the locking claws 103*c* of the receptacle member 103 as shown in FIG. 46A, and the connector member 104 is still accommodated and held inside the through-hole 103*a* in the receptacle member 103. Moreover, in the pre-mated state, the projections 102*f* of the lock release ribs 102*d* of the first electrical connector 102 are pressed inward by the projections 103*d* of the receptacle member 103, as shown in FIG. 47A. As a result, the locking members 104*e* of the connector member 104 are displaced inward, so that the locking members 104*e* are not completely engaged with the engaging windows 102*g*. Accordingly, the first electrical connector 102 and the connector member 104 are not locked together.

When the first electrical connector 102 moves further in the direction of the arrow A shown in FIGS. 39-40 from the pre-mated state by the gap g in FIG. 47B, the first electrical connector 102 and connector member 104 are placed in a state immediately prior to a completed mating position, as shown in FIGS. 43-44. In this position immediately prior to the completed mating position, the lock release members 102*b* of the first electrical connector 102 press the elastic locking ribs 103*b* of the receptacle member 103 outward, so that the engagement of the locking members 104*d* of the connector member 104 by the locking claws 103*c* of the receptacle member 103 is released, as shown in FIG. 46C-46D. In this position immediately prior to the completed mating position, the projections 102*f* of the lock release ribs 102*d* of the first electrical connector 102 are still pressed inward by the projections 103*d* of the receptacle member 103, as shown in FIG. 47B, which causes the locking members 104*e* of the connector member 104 to be displaced inward, so that the locking members 104*e* are not completely engaged with the engaging windows 102*g*. Consequently, the first electrical connector 102 and connector member 104 are not locked together.

When the first electrical connector 102 moves further in the direction of the arrow A shown in FIGS. 39-40, the pressed state of the projections 102*f* of the lock release ribs 102*d* by the projections 103*d* of the receptacle member 103 is released, as shown in FIG. 47C, so that the locking members 104*e* of the connector member 104 are completely engaged with the engaging windows 102*g*. As a result, the first electrical connector 102 and connector member 104 are locked together, thus completing the mating between the first and second electrical connectors 102, 105. Moreover, the front end of the first electrical connector 102 presses the flange 104*b* of the connector member 104, as shown in FIG. 45. As shown in FIG. 45, because the connector member 104 is away from the inner wall surfaces of the receptacle member 103, it is possible to prevent the transmission of vibration on the side of the second structural body (not shown) attached to the receptacle member 103 to the connector member 104. Thus, the generation of vibration stress or abnormal noise caused by the vibration is prevented.

Several problems, however, have been encountered with the second electrical connector 105. Specifically, before the first electrical connector 102 and the connector member 104, the lock release members 102*b* of the first electrical connector 102 press the locking claws 103*c* of the connector member 104 outward, as shown in FIG. 46D, and the locking of the locking members 104*d* of the connector member 104 by the locking claws 103*c* of the receptacle member 103 is released, as shown in FIG. 46C, so that the movement of the connector member 104 becomes possible. Accordingly, there are cases in which the first electrical connector 102 does not completely mate with the connector member 104, creating a so-called half-mated state.

Furthermore, As shown in FIGS. 39-40, when the first electrical connector 102 moves in the direction of the arrow A shown in FIGS. 39-40 from the state in which the second electrical connector 105 and the first electrical connector 102 are not connected, the front end of the first electrical connector 102 is inserted into the through-hole 103*a* in the receptacle member 103 of the electrical connector 105. However, because the receptacle member 103 does not possess any structure for guiding the first electrical connector 102, the first electrical connector 102 and the connector member 104 may collide due to a lack of alignment of the axes. Thus, mating cannot be accomplished in one operation.

Moreover, when the first electrical connector 102 is erroneously inserted into the through-hole 103*a* in the receptacle member 103, for example, when the first electrical connector 102 is inserted upside down, the first electrical connector 102 is still capable of sliding into the through-hole 103*a* in the receptacle member 103. Thus, the first electrical connector 102 can easily be erroneously attached to the connector member 104.

BRIEF SUMMARY

It is an object of the invention to provide an electrical connector that is electrically connected to a circuit unit comprising a first connector, wherein the electrical connector can reliably prevent half-mating of the first connector with a second connector accommodated inside a cover member.

This and other objects are achieved by a connector device comprising a circuit unit including a first connector provided with a plurality of contacts. The circuit unit is moveable between a mating position and a final mating position. An electrical connector includes a cover member and a second connector provided with a plurality of contacts that is arranged in the cover member. The cover member has a first connector housing receiving recess that receives the first connector. At least one locking projection locks the second connector in the cover member when the circuit unit is in the mating position. The contacts of the first connector are electrically connected to the contacts of the second connector in the mating position. At least one lock release projection unlocks the second connector when the first connector is moved from the mating position to the final mating position. The contacts of the first connector are electrically connected to the contacts of the second connector in the final mating position.

DETAILED DESCRIPTION OF THE EMBODIMENT(S)

Figure 1:
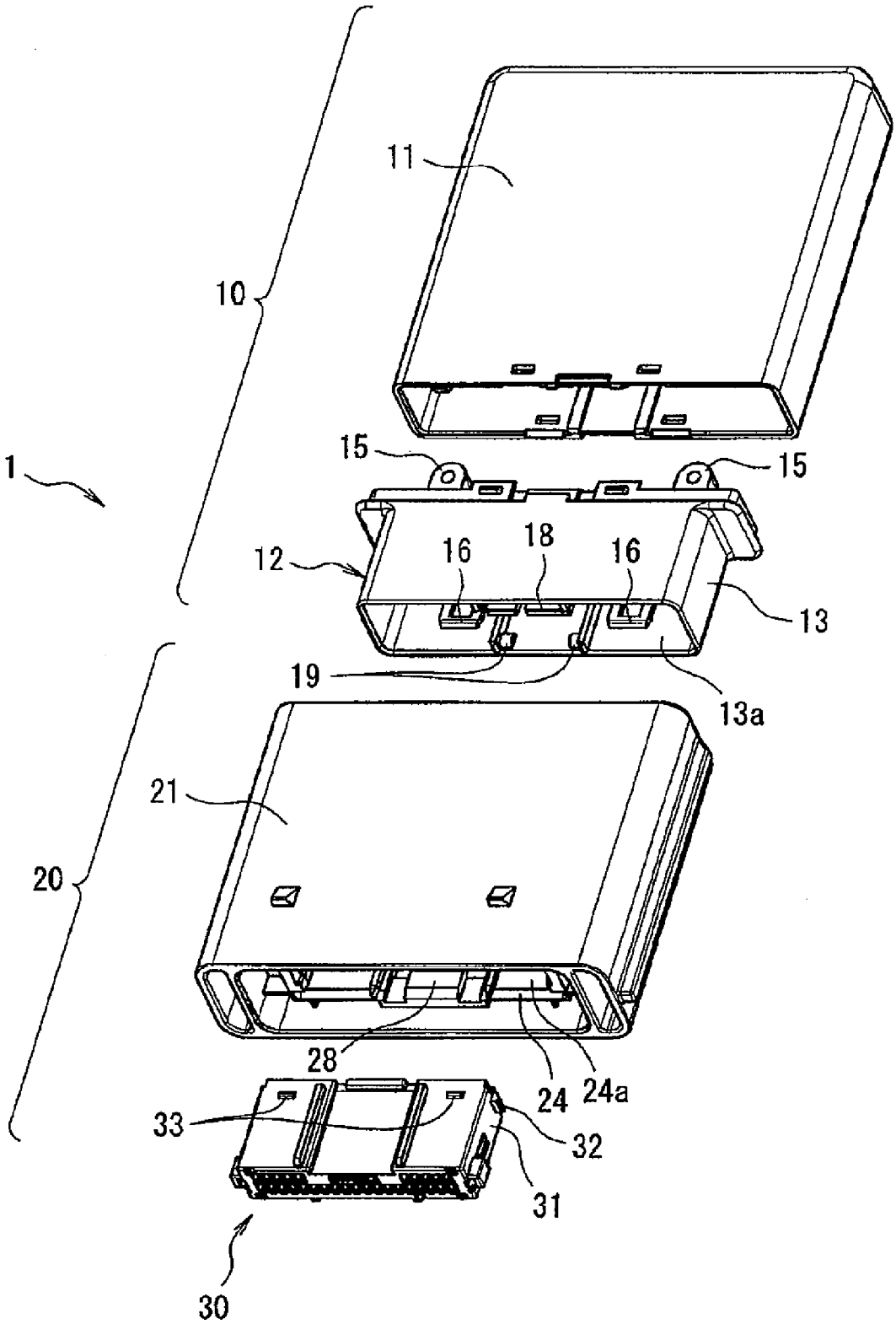
FIG. 1 is an exploded perspective view of a connector device consisting of a first embodiment of an electrical connector according to the invention and a circuit unit that mates with and is electrically connected thereto, with the electrical connector being seen from a back side and the circuit unit being seen from a front side.
Figure 2:
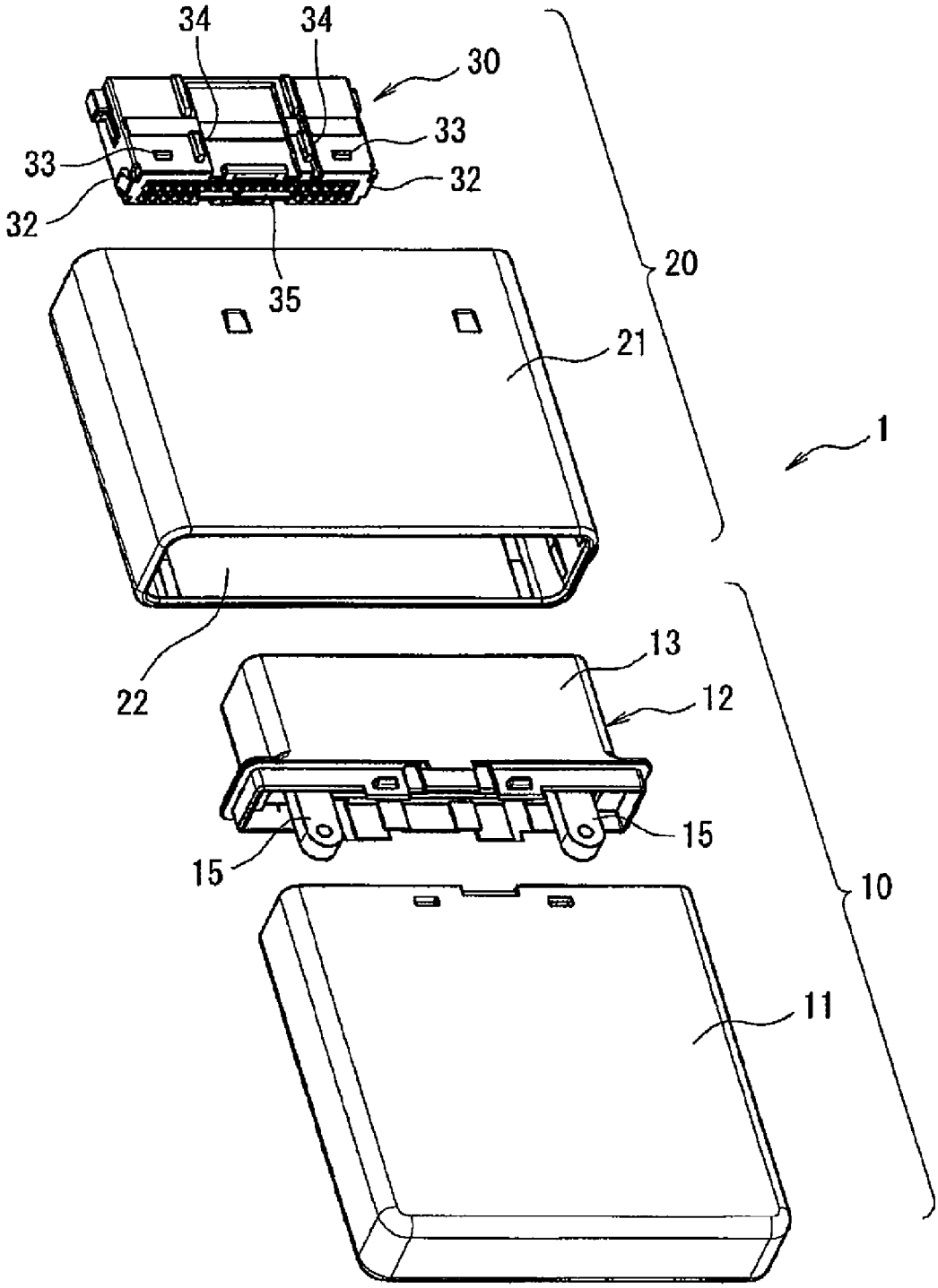
FIG. 2 is an exploded perspective view of the connector device of FIG. 1, with the electrical connector being seen from a front side and the circuit unit being seen from a back side.
Figure 3:
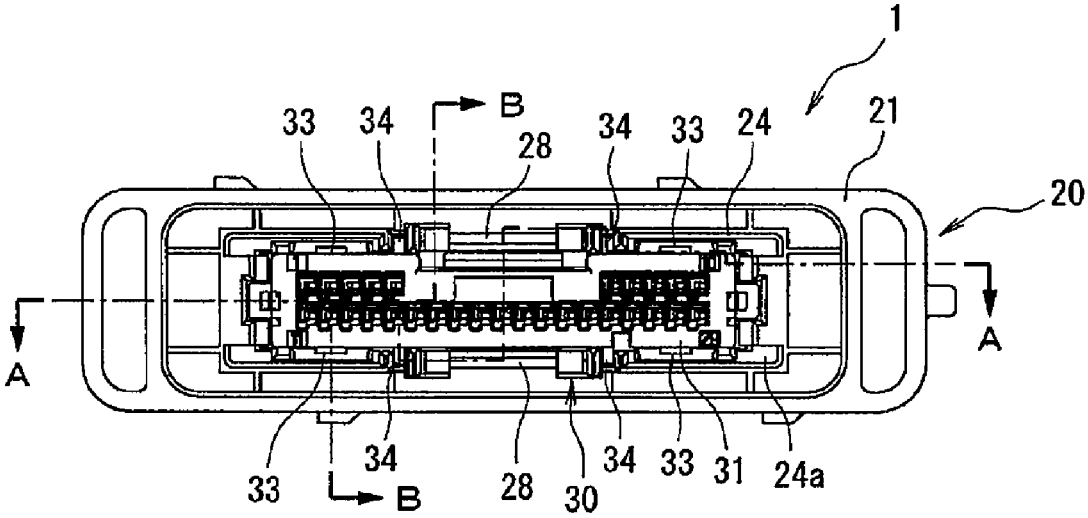
FIG. 3 is a rear view of the connector device of FIG. 1 shown from the back side of the receptacle electrical connector.
Figure 4:
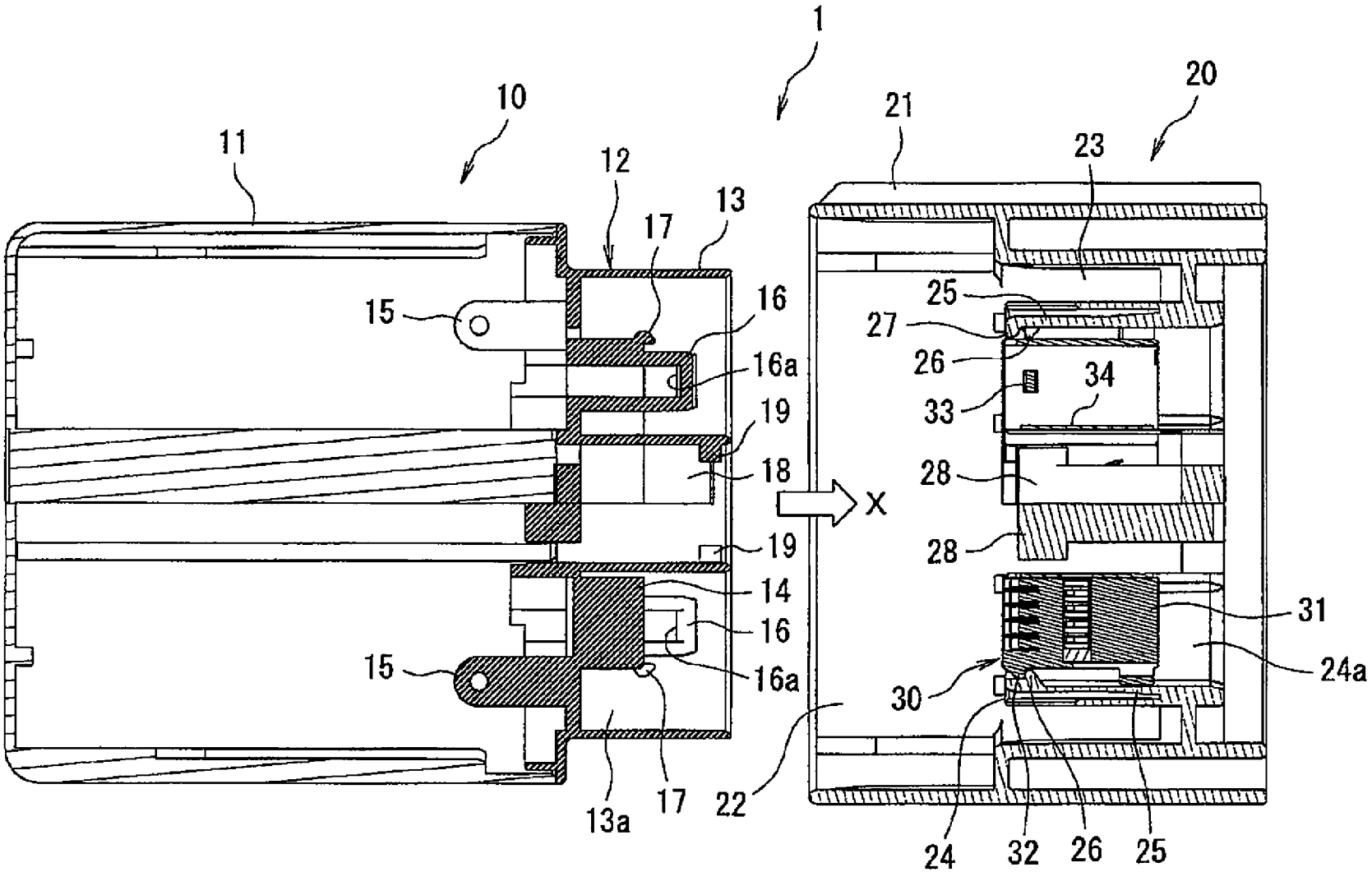
FIG. 4 is a sectional view along line A-A in FIG. 3 showing a state in which the circuit unit and the electrical connector are not mated.

FIGS. 1-23 show a connector device 1 consisting of a first embodiment of an electrical connector 20 according to the invention and a circuit unit 10 that mates with and is electrically connected thereto. As shown in FIGS. 1-2 and 4, the circuit unit 10 comprises a substantially square circuit unit housing 11 and a first connector 12. The first connector 12 has a substantially square first connector housing 13 fastened to a front end (right side in FIG. 4) of the circuit unit housing 11. As shown in FIG. 4, the first connector housing 13 has a width smaller than a width of the circuit unit housing 11. A recess 13*a* is formed in the first connector housing 13 and opens on a front surface of the first connector housing 13. As shown in FIG. 4, a substantially rectangular contact fastening member 14 that extends in a direction of the width of the first connector housing 13 is provided on an inside of the recess 13*a* so that the contact fastening member 14 protrudes forward from a bottom of the recess 13*a*. A plurality of rows of contacts (not shown) is attached to the contact fastening member 14.

A pair of circuit board fastening members 15 for fastening the first connector housing 13 to a surface of a circuit board (not shown) fastened inside the circuit unit housing 111 is provided on a rear end of the first connector housing 13. Rear end portions of the contacts (not shown) are connected to the circuit board (not shown), for example, by soldering. Locking members 16 are provided on upper and lower surfaces of the contact fastening member 14 and protrude forward there from. An opening 16*a* is formed in each of the locking members 16. First lock release projections 17 are provided on side surfaces of the contact fastening members 14 in the direction of width at ends thereof. An alignment plate 18 extends forward from substantially a center in the direction of width of a front surface of the contact fastening member 14 slightly toward the upper side in a vertical direction. Pressing projections 19 are provided on the inner surfaces of upper and lower walls of the first connector housing 13 in substantially a center thereof.

As shown in FIGS. 1-2 and 4, the electrical connector 20 is a receptacle electrical connector and comprises a cover member 21 and a second connector 30. The cover member 21 has a substantially square shape. A circuit unit housing receiving recess 22 that receives the circuit unit housing 11 is formed in a front portion (left side in FIG. 4) of the cover member 21 and a first connector housing receiving recess 23 that receives the first connector housing 13 is formed in a rear portion of the cover member 21. A substantially rectangular connector accommodating member 24 that accommodates the second connector 30 is formed in an interior of the first connector housing receiving recess 23. A through-hole 24*a* that extends in a forward-rearward direction of the cover member 21 is provided in the interior of the connector accommodating member 24 and is configured to receive the second connector 30. Latch arms 25 are provided on side walls of the connector accommodating member 24 in the direction of width. The latch arms 25 have a substantially cantilever shape and extend forward from a rear portion of the side walls of the connector accommodating member 24 in the direction of width so that tip ends of the latch arms 25 protrude into the through-hole 24*a*.

Figure 5:
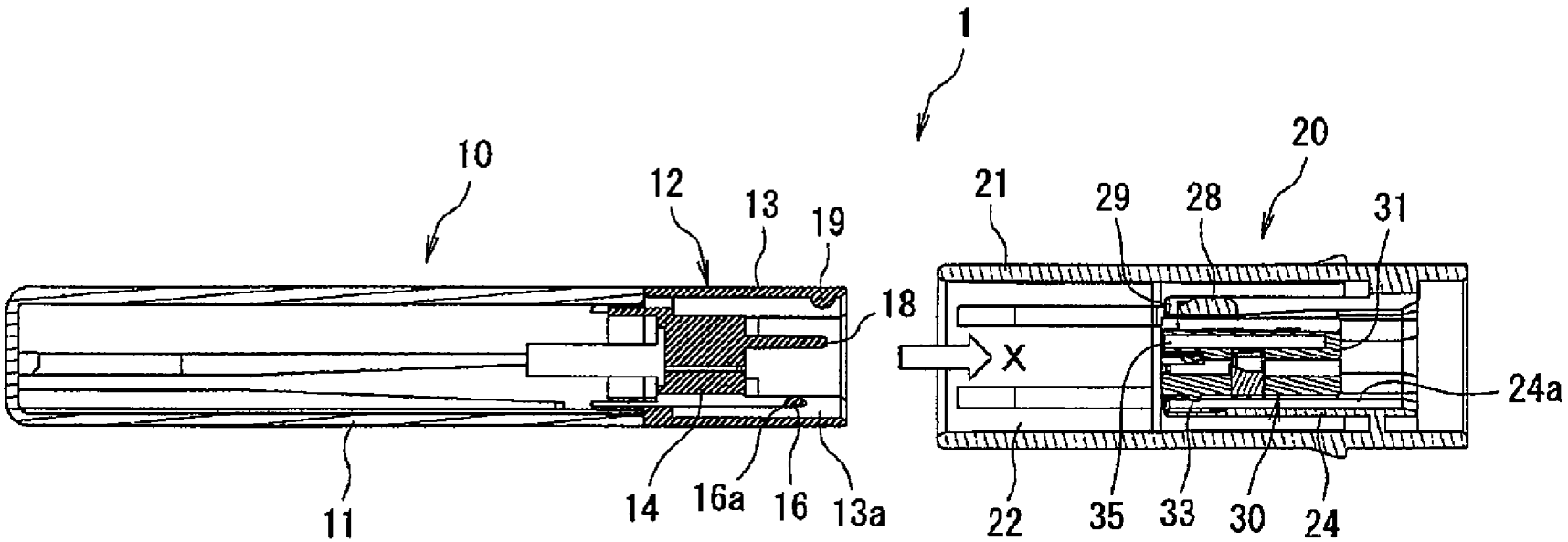
FIG. 5 is a sectional view along line B-B in FIG. 3 showing the state in which a first connector and second connector are not mated.

First locking projections 26 for locking the second connector 30 inside the connector accommodating member 24 are formed at the tip ends of the latch arms 25 in a substantially center thereof in a vertical direction so that the first locking projections 26 protrude into the through-hole 24*a*. Second lock release projections 27 for releasing the locking of the second connector 30 by the first locking projections 26 are formed at the tip ends of the latch arms 25 at upper and lower ends thereof in the vertical direction so that the second lock release projections 27 protrude into the through-hole 24*a*. As shown in FIG. 5, stopper projections 29 are provided on upper and lower walls of the connector accommodating member 24 at front end portions thereof. As shown in FIGS. 1 and 4, substantially cantilever support arms 28 that extend from a vicinity of the rear end portion of the connector accommodating member 24 to a vicinity of the front end portion of the connector accommodating member 24 are provided on upper and lower walls of the cover member 21.

As shown in FIGS. 1-4, the second connector 30 comprises a substantially rectangular second connector housing 31. Contacts (not shown) are attached to the second connector housing 31 in a plurality of rows and make contact with the contacts (not shown) of the first connector 12 in front portions thereof. The contacts (not shown) are connected to a wire harness or electrical wires (not shown) in rear portions thereof. The second connector 30 is designed to be accommodated inside the through-hole 24*a* in the connector accommodating member 24 of the cover member 21 from a rear of the cover member 21 after being attached to one end of the electrical wires (not shown). Second locking projections 32 that engage with the first locking projections 26 provided on the connector accommodating member 24 are formed on end surfaces in the direction of width of the second connector housing 31. As shown in FIG. 4, the second locking projections 32 ride over the first locking projections 26 and are positioned in front of the first locking projections 26. When the second locking projections 32 are positioned in front of the first locking projections 26, the front end surface of the second connector housing 31 of the second connector 30 substantially coincides with the front end surface of the connector accommodating member 24. As a result, of the engagement between the first locking projections 26 and the second locking projections 32, rearward movement of the second connector 30 is restricted.

As shown in FIG. 4, projecting ribs 34 that extend in a forward-rearward direction protrude from upper and lower surfaces of the second connector housing 31 of the second connector 30. The projecting ribs 34 are configured such that forward movement of the second connector 30 is restricted by the front end surfaces of the projecting ribs 34 contacting the rear end surfaces of the stopper projections 29 provided on the connector accommodating member 24. Locking projections 33 are formed so as to protrude from front end portions of upper and lower surfaces of the second connector housing 31. The locking projections 33 are configured to enter the openings 16*a* of the locking members 16 of the first connector 12 to lock the first connector 12 to the second connector 30. As shown in FIG. 5, an alignment aperture 35 into which the alignment plate 18 of the first connector 12 is fitted is bored in substantially a center in the direction of width of the front surface of the second connector housing 31 slightly toward the upper side in the vertical direction.

The mating of the circuit unit 10 and the electrical connector 20 will now be described. As shown in FIGS. 4-5, the circuit unit 10 is advanced in a direction of arrow X from the state shown in FIGS. 4-5 in which the circuit unit 10 and the electrical connector 20 are not mated, so that the first connector housing 13 is inserted into the first connector housing receiving recess 23 in the cover member 21, and the circuit unit housing 11 is inserted into the circuit unit housing receiving recess 22 in the cover member 21. The first connector housing 13 is guided along the inner walls of the first connector housing receiving recess 23 of the cover member 21, and the circuit unit housing 11 is guided along the inner walls of the circuit unit housing receiving recess 22 of the cover member 21. Accordingly, the first connector 12 and the second connector 30 mate with each other. Because the axes of the first connector 12 and the second connector 30 are aligned, mating can be accomplished in one operation.

Figure 6:
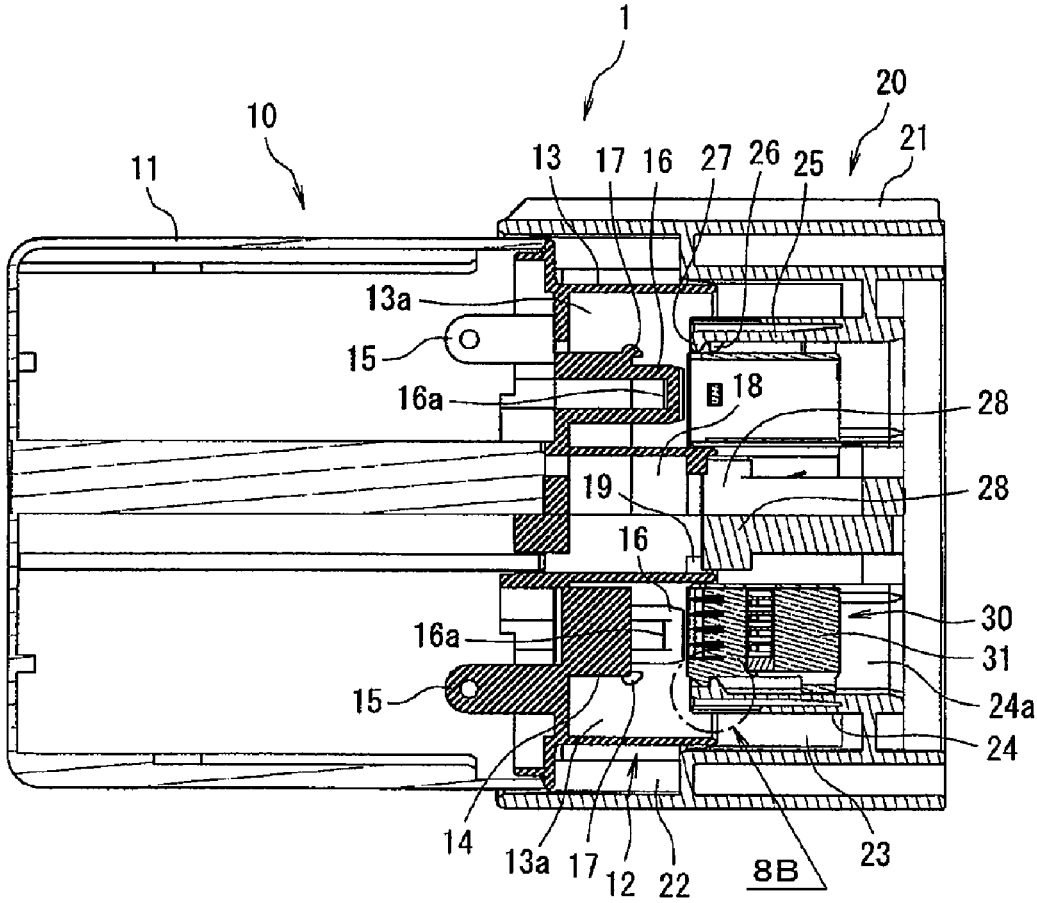
FIG. 6 is a sectional view along line A-A in FIG. 3 showing an initial mating position of the first connector and the second connector.
Figure 7:
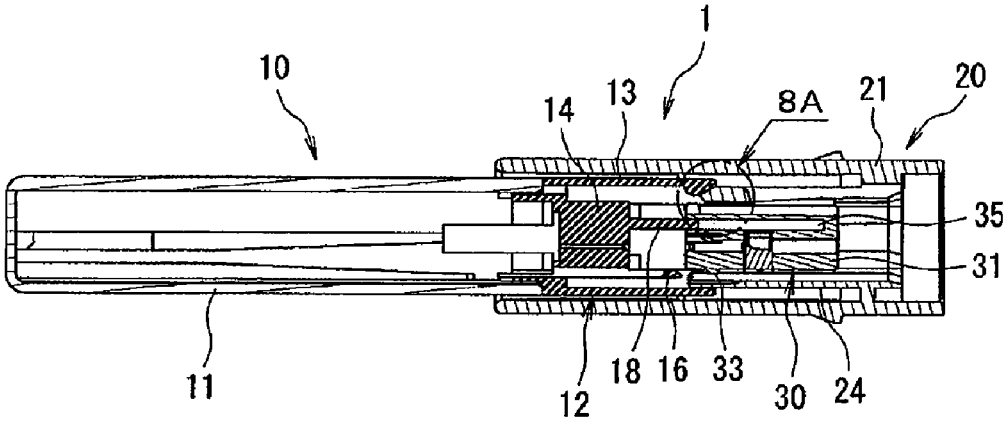
FIG. 7 is a sectional view along line B-B in FIG. 3 showing the initial mating position of the first connector and the second connector.

If the circuit unit 10 is inserted into the cover member 21 from a side opposite from the side where the first connector 12 is located, then the circuit unit housing 11 contacts the step member located at the boundary between the first connector housing receiving recess 23 and the circuit unit housing receiving recess 22 inside the cover member 21. Thus, erroneous insertion with the front and rear of the circuit unit 10 being reversed is prevented. As shown in FIGS. 6-7, when the circuit unit 10 is inserted with the first connector 12 in front, the alignment plate 18 provided on the first connector 12 enters the alignment aperture 35 formed in the second connector 30, so that the mating between the first connector 12 and the second connector 30 is initiated.

If the circuit unit 10 is turned upside down and the first connector 12 is inserted into the cover member 21 upside down from the state shown in FIGS. 4-5, then the alignment plate 18 provided on the first connector 12 contacts the front end surface of the second connector housing 31 of the second connector 30 without entering the alignment aperture 35 formed in the second connector 30. Therefore, because the alignment plate 18 is provided on the front surface of the contact fastening member 14 slightly toward the upper side in the vertical direction, and the alignment aperture 35 into which the alignment plate 18 is fitted is formed in the front surface of the second connector housing 31 of the second connector 30 slightly toward the upper side in the vertical direction, if the first connector 12 is turned upside down, the alignment plate 18 is positioned slightly toward the lower side in the vertical direction. Accordingly, if the first connector 12 is inserted into the cover member 21 upside down as a result of the circuit unit 10 being turned upside down, then the mating between the first connector 12 and the second connector 30 is prevented by the alignment plate 18 and the alignment aperture 35. Consequently, the circuit unit 10 cannot be inserted into a completed mating position thereby enabling any erroneous insertion thereof to be easily detected.

Figure 8A:
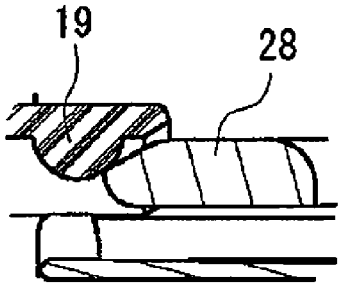
FIG. 8A is an enlarged view of area 8A in FIG. 7.
Figure 8B:
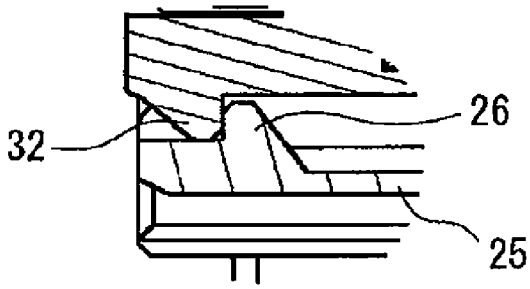
FIG. 8B is an enlarged view of area 8B in FIG. 6.
Figure 9:
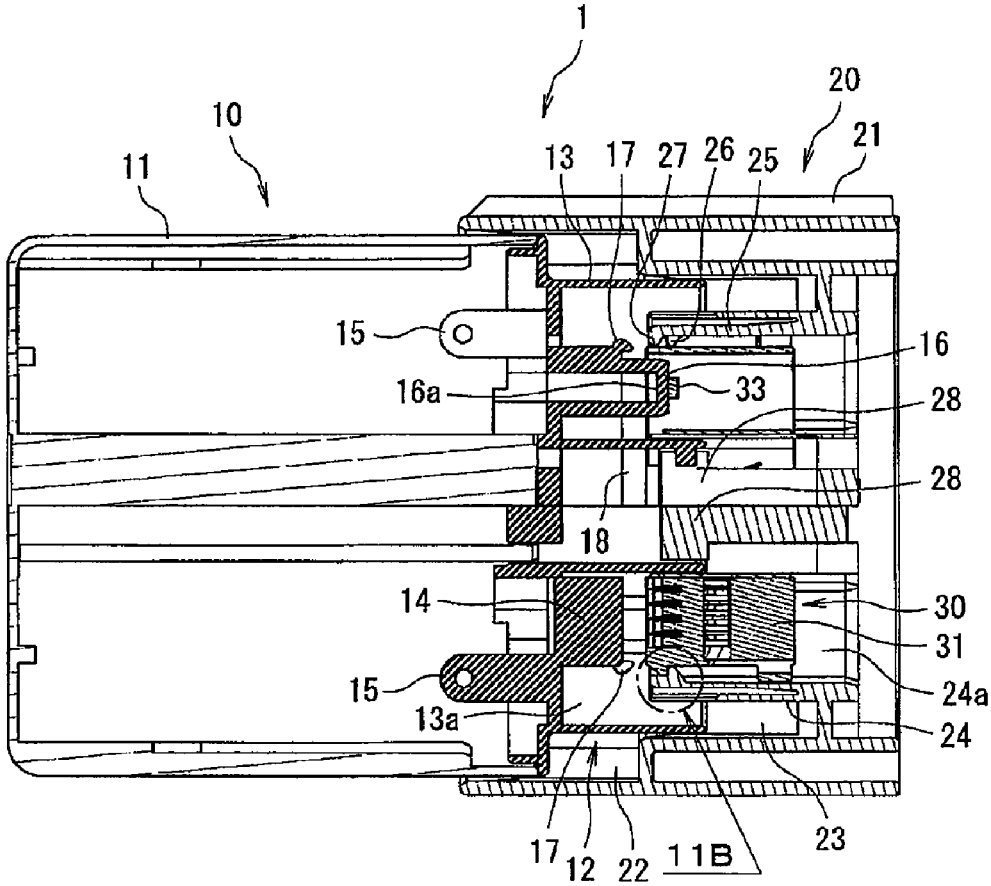
FIG. 9 is a sectional view along line A-A in FIG. 3 showing an intermediate mating position between the first connector and the second connector.
Figure 10:
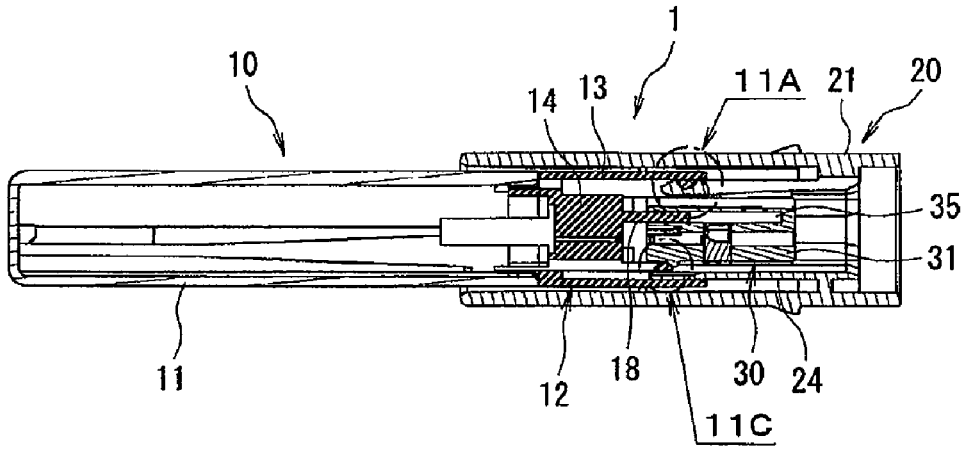
FIG. 10 is a sectional view along line B-B in FIG. 3 showing the intermediate mating position between the first connector and the second connector.

FIGS. 6-8B show the first connector 12 and the second connector 30 in an initial mating position. In this position, as shown in FIG. 8B, the second locking projections 32 of the second connector 30 are located in front of the first locking projections 26 and are therefore placed in a locked state. Accordingly, the rearward movement of the second connector 30 is restricted. Additionally, in this position, as shown in FIG. 8A, the pressing projections 19 provided on the first connector 12 contact the support arms 28 provided on the cover member 21. Further, in this position, the contacts (not shown) provided on the first connector 12 and the contacts (not shown) provided on the second connector 30 have not yet come into contact.

Figure 11A:
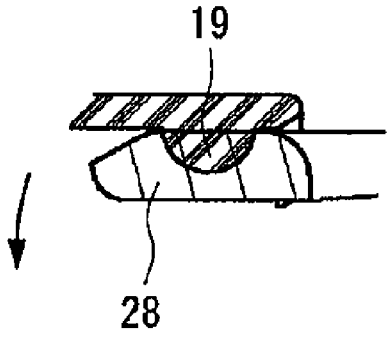
FIG. 11A is an enlarged view of area 11A in FIG. 10.
Figure 11B:
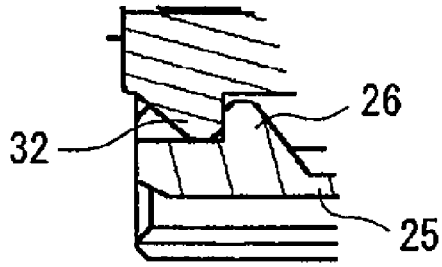
FIG. 11B is an enlarged view of area 11B in FIG. 9.
Figure 11C:
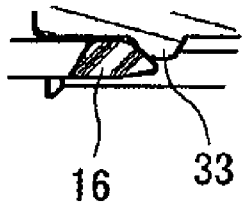
FIG. 11C is an enlarged view of area 11C in FIG. 10.
Figure 12:
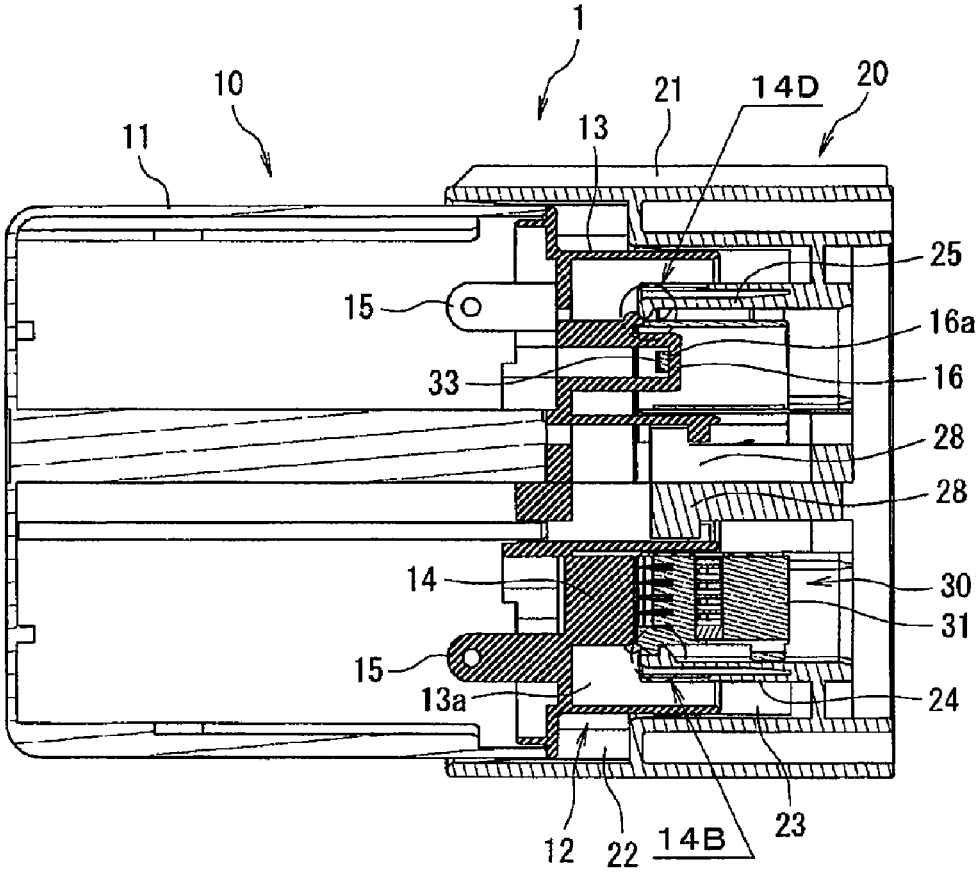
FIG. 12 is a sectional view along line A-A in FIG. 3 showing a mating position between the first connector and the second connector.
Figure 13:
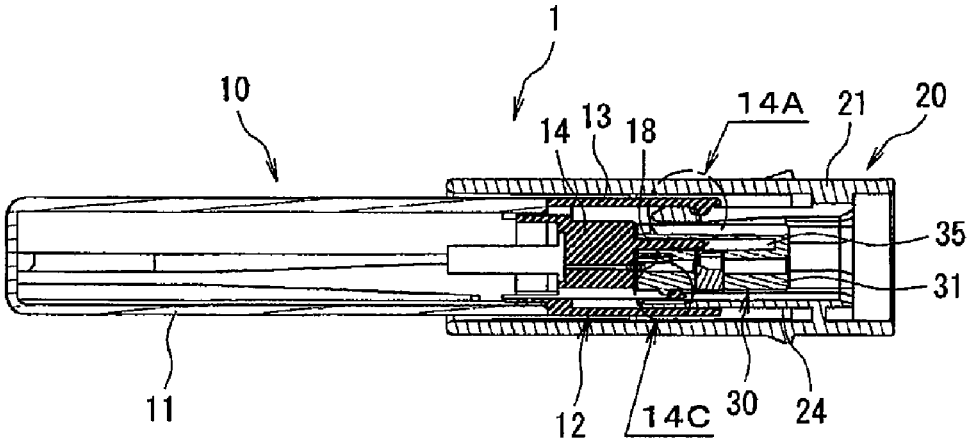
FIG. 13 is a sectional view along line B-B in FIG. 3 showing the mating position between the first connector and the second connector.

When the circuit unit 10 is caused to advance further from the state shown in FIGS. 6-8B, the first connector 12 and the second connector 30 are placed in an intermediate mating position, as shown in FIGS. 9-11C. In this position, the first connector housing 13 is guided along the inner walls of the first connector housing receiving recess 23 of the cover member 21, while the circuit unit housing 11 is guided along the inner walls of the circuit unit housing receiving recess 22 of the cover member 21. In this position, as shown in FIG. 11A, the pressing projections 19 provided on the upper side of the first connector 12 press the support arm 28 provided on the upper side of the cover member 21 in a downward direction (in a direction of the arrow in FIG. 11A), and the pressing projections 19 provided on the lower side of the first connector 12 press the support arm 28 provided on the lower side of the cover member 21 in an upward direction, so that the second connector 30 is arranged between the support arms 28 and is secured in place. As shown in FIG. 11B, the second locking projections 32 of the second connector 30 are still located in front of the first locking projections 26 and are therefore still placed in a locked state, thus restricting the rearward movement of the second connector 30. In this position, the locking members 16 of the first connector 12 make contact with the locking projections 33 of the second connector 30, as shown in FIG. 11C. Moreover, the contacts (not shown) provided on the first connector 12 and the contacts (not shown) provided on the second connector 30 come into contact. Because the second connector 30 is fastened in place by the support arms 28 when the contacts (not shown) come into contact, the contact between the contacts (not shown) is reliably accomplished. As a result, the circuit unit 10 and electrical connector 20 are electrically connected.

Figure 14A:
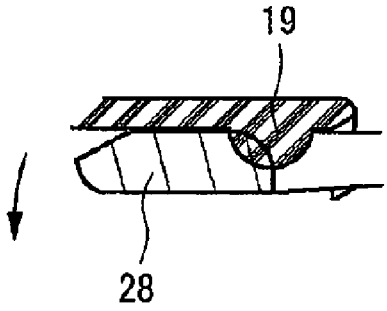
FIG. 14A is an enlarged view of area 14A in FIG. 13.
Figure 14B:
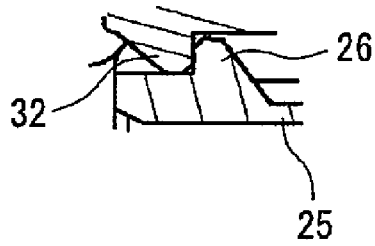
FIG. 14B is an enlarged view of area 14B in FIG. 12.
Figure 14C:
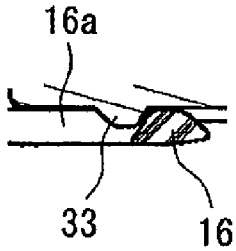
FIG. 14C is an enlarged view of area 14C in FIG. 13.
Figure 14D:
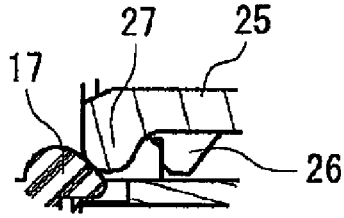
FIG. 14D is an enlarged view of area 14D in FIG. 12.
Figure 15:
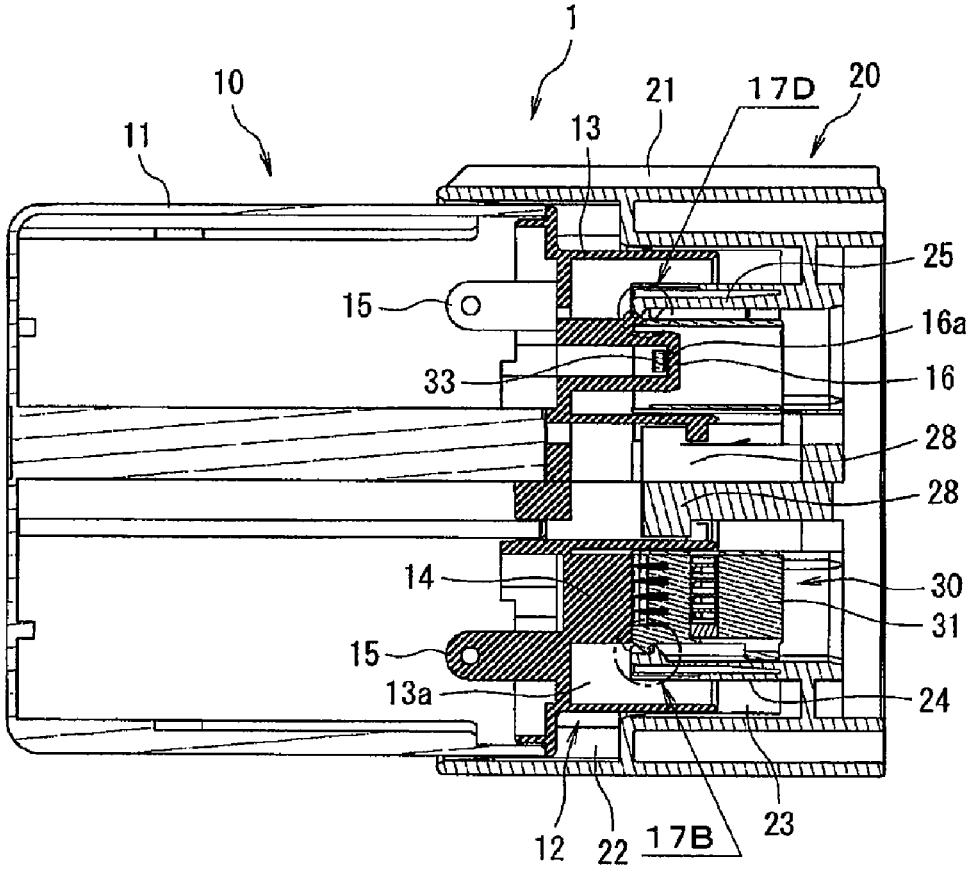
FIG. 15 is a sectional view along line A-A in FIG. 3 showing a state in which the release of the locking of the second connector has been initiated following the completion of the mating between the first connector and the second connector.
Figure 16:
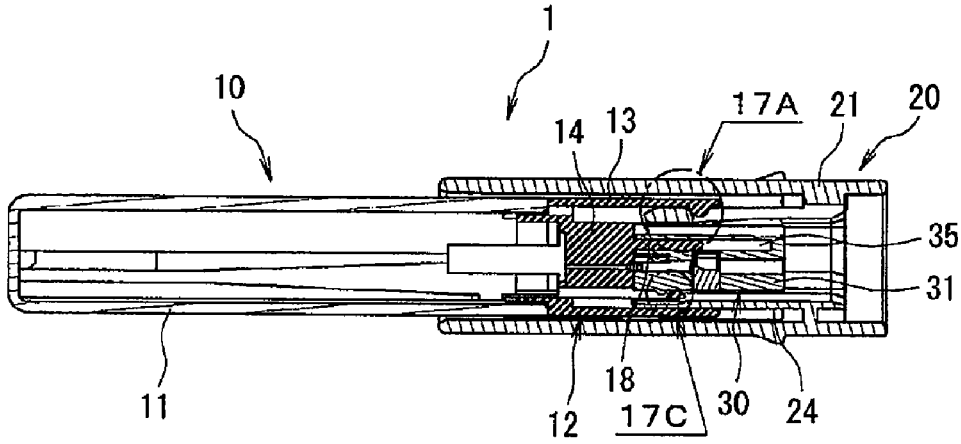
FIG. 16 is a sectional view along line B-B in FIG. 3 showing the state in which the release of the locking of the second connector has been initiated following the completion of the mating between the first connector and the second connector.

When the circuit unit 10 is caused to advance further from the state shown in FIGS. 9-11C, the first connector 12 and the second connector 30 are placed in a mating position, as shown in FIGS. 12-14D. In the mating position, the mating between the first connector 12 and the second connector 30 has been completed. In this position, the first connector housing 13 is guided along the inner walls of the first connector housing receiving recess 23 of the cover member 21, while the circuit unit housing 11 is guided along the inner walls of the circuit unit housing receiving recess 22 of the cover member 21. As shown in FIG. 14A, the pressing projections 19 provided on the upper side of the first connector 12 still press the support arm 28 provided on the upper side of the cover member 21 in the downward direction (in the direction of the arrow in FIG. 14A), and the pressing projections 19 provided on the lower side of the first connector 12 still press the support arm 28 provided on the lower side of the cover member 21 in the upward direction, thus positioning the second connector 30 between the support arms 28 and securing the second connector 30 in place. As shown in FIG. 14B, the second locking projections 32 of the second connector 30 are still positioned in front of the first locking projections 26 and are therefore still placed in a locked state, so that the rearward movement of the second connector 30 is still restricted. The first lock release projections 17 provided on the first connector 12 contact the second lock release projections 27 provided on the latch arms 25 of the cover member 21, as shown in FIG. 14D. Moreover, as shown in FIG. 14C, the locking members 16 of the first connector 12 ride over the locking projections 33 of the second connector 30, and the locking projections 33 enter the openings 16*a*, thus completing the locking of the first connector 12 and the second connector 30.

Figure 17A:
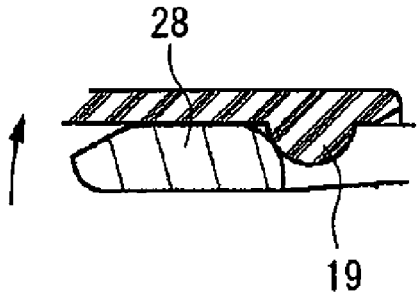
FIG. 17A is an enlarged view of area 17A in FIG. 16.
Figure 17B:
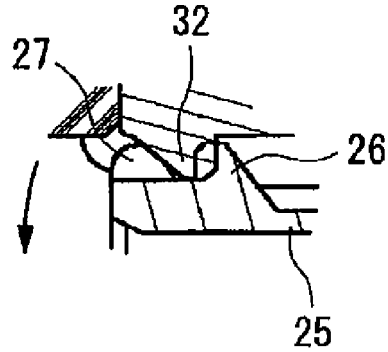
FIG. 17B is an enlarged view of area 17B in FIG. 15.
Figure 17C:
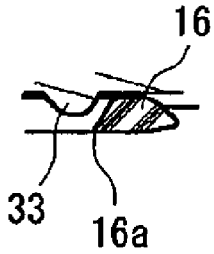
FIG. 17C is an enlarged view of area 17C in FIG. 16.
Figure 17D:
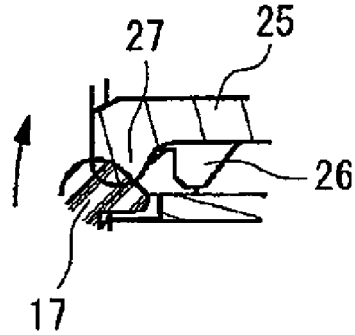
FIG. 17D is an enlarged view of area 17D in FIG. 15.
Figure 18:
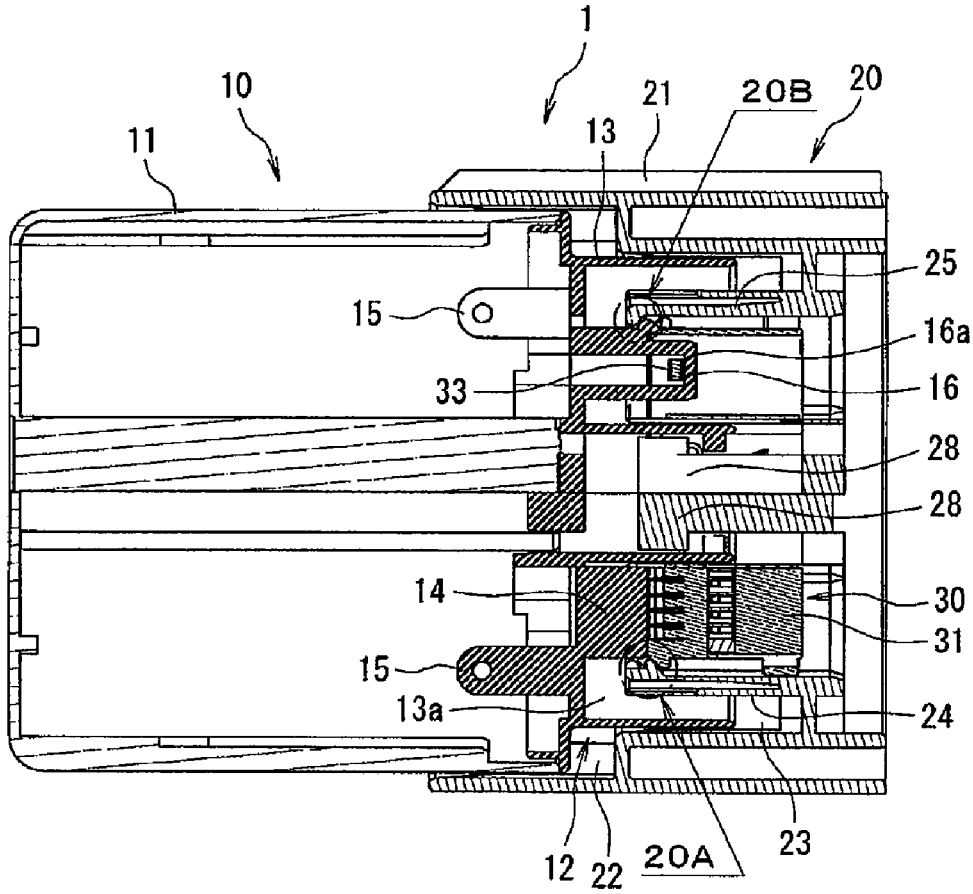
FIG. 18 is a sectional view along line A-A in FIG. 3 showing a state in which the release of the locking of the second connector has been completed.
Figure 19:
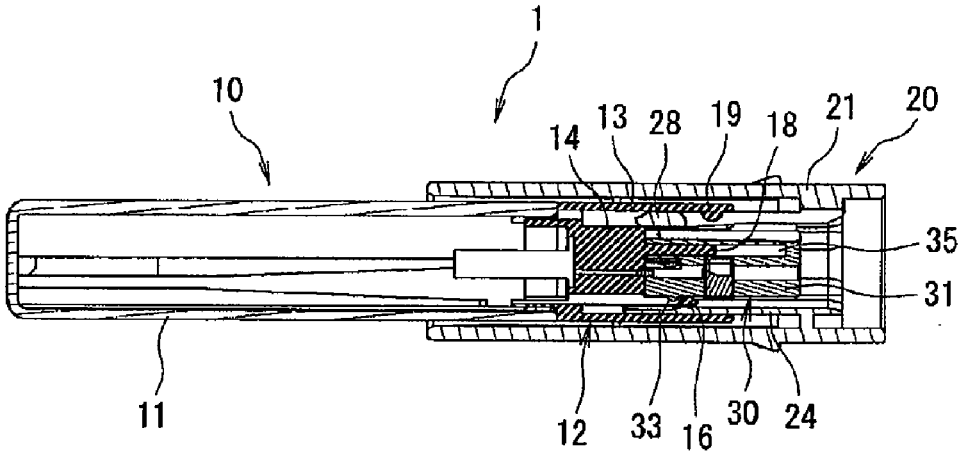
FIG. 19 is a sectional view along line B-B in FIG. 3 showing the state in which the release of the locking of the second connector has been completed.

When the circuit unit 10 is caused to advance further from the state shown in FIGS. 12-14D, a state is created in which the circuit unit 10 is inserted further into the electrical connector 20 from the mating position, as shown in FIGS. 15-17D. In this state, the first connector housing 13 is guided along the inner walls of the first connector housing receiving recess 23 of the cover member 21, while the circuit unit housing 11 is guided along the inner walls of the circuit unit housing receiving recess 22 of the cover member 21. As shown in FIG. 17A, the pressing of the support arm 28 by the pressing projections 19 provided on the upper side of the first connector 12 is released, and the pressing of the support arm 28 by the pressing projections 19 provided on the lower side of the first connector 12 is released. As shown in FIG. 17D, the first lock release projections 17 press-open the latch arms 25 via the second lock release projections 27 provided on the latch arms 25. As a result, the release of the locking of the second connector 30 by the first locking projections 26 is initiated. Specifically, as shown in FIG. 17B, as a result of the latch arm 25 being pressed-open in a direction of the arrow shown in FIG. 17B, the first projection 26 provided on the latch arm 25 also moves in the direction of the arrow shown in FIG. 17B, thus initiating the release of the locking of the second projection 32 provided on the second connector 30 by the first projection 26. As shown in FIG. 17C, the locking members 16 of the first connector 12 have ridden over the locking projections 33 of the second connector 30, and the locking projections 33 have entered the openings 16*a*, so that the state of locking between the first connector 12 and the second connector 30 is maintained.

Figure 20A:
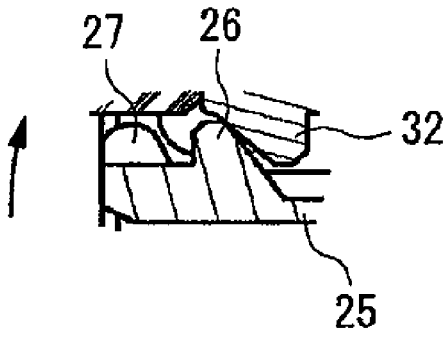
FIG. 20A is an enlarged view of area 20A in FIG. 18.
Figure 20B:
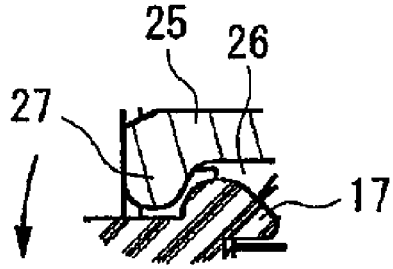
FIG. 20B is an enlarged view of area 20B in FIG. 18.
Figure 21:
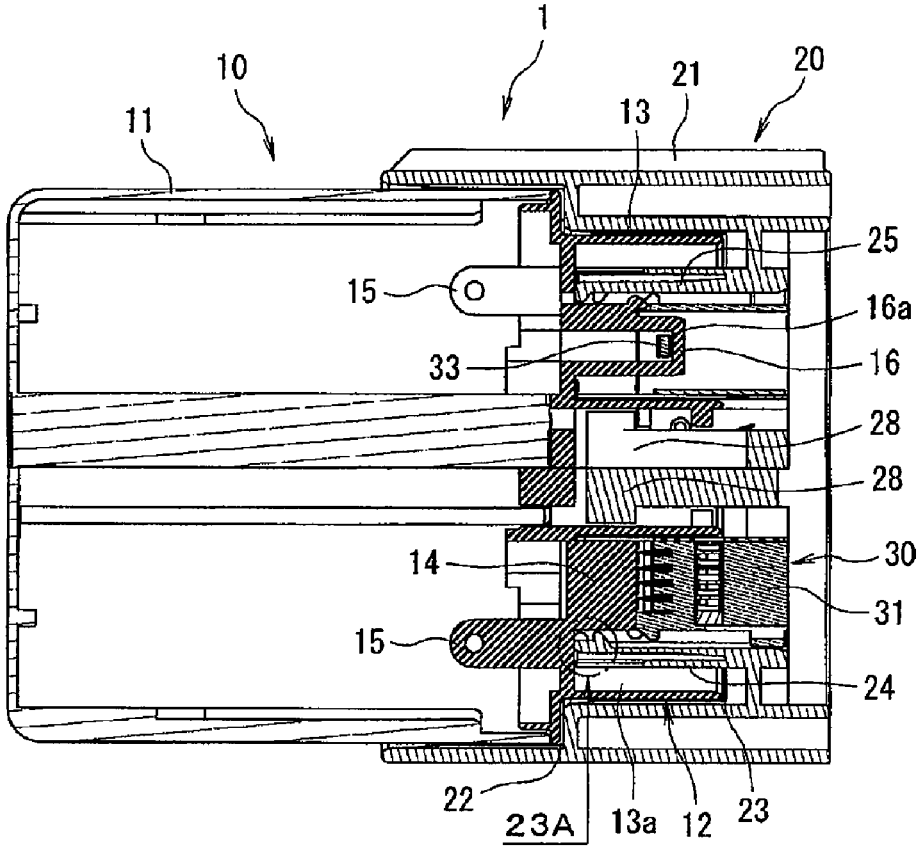
FIG. 21 is a sectional view along line A-A in FIG. 3 showing a final mating position between the first connector and the second connector.
Figure 22:
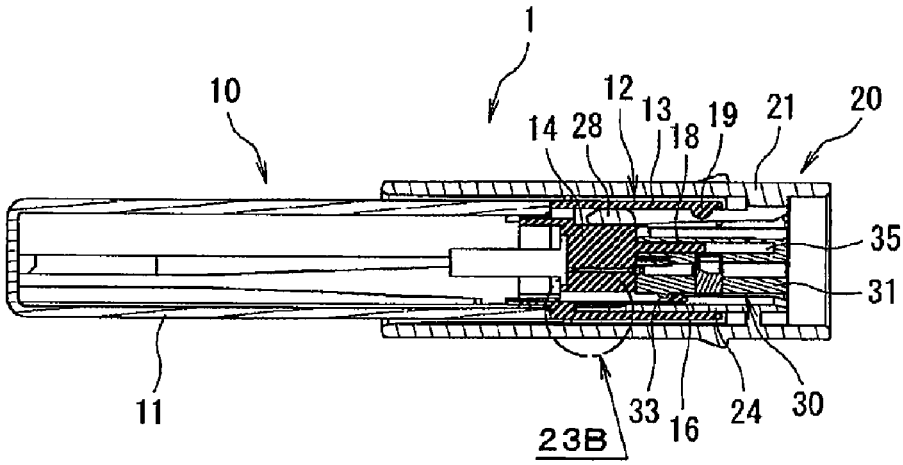
FIG. 22 is a sectional view along line B-B in FIG. 3 showing the final mating position between the first connector and the second connector.

When the circuit unit 10 is caused to advance further from the state shown in FIGS. 15-17D, a state is created in which the circuit unit 10 is inserted further into the electrical connector 20 from the mating position, as shown in FIGS. 18-20B. In this position, the first connector housing 13 is guided along the inner walls of the first connector housing receiving recess 23 of the cover member 21, while the circuit unit housing 11 is guided along the inner walls of the circuit unit housing receiving recess 22 of the cover member 21. As shown in FIG. 20B, the first lock release projections 17 ride over the second lock release projections 27 provided on the latch arms 25, and the latch arm 25 moves in a direction of the arrow shown in FIG. 20B and then returns to its original position. As shown in FIG. 20A, the second projections 32 then moves rearward together with the second connector 30 and are positioned on the rear side of the first projections 26 provided on the latch arms 25. As a result, the release of the locking of the second connector 30 by the first locking projections 26 is completed. Furthermore, the locking members 16 of the first connector 12 have ridden over the locking projections 33 of the second connector 30, and the locking projections 33 have entered the openings 16*a*, so that the state of locking between the first connector 12 and the second connector 30 is maintained. When the release of the locking of the second connector 30 by the first locking projections 26 is completed, the second connector 30 can slide in the direction of insertion and removal of the circuit unit 10 inside the connector accommodating member 24.

Figure 23A:
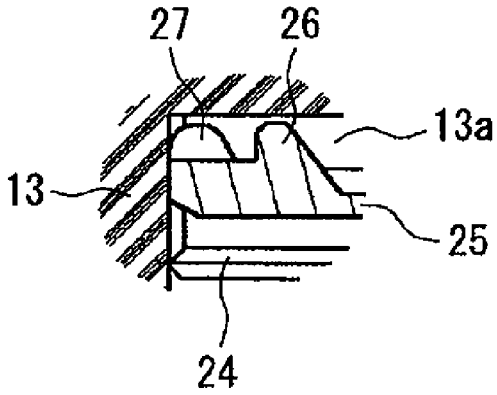
FIG. 23A is an enlarged view of area 23A in FIG. 21.
Figure 23B:
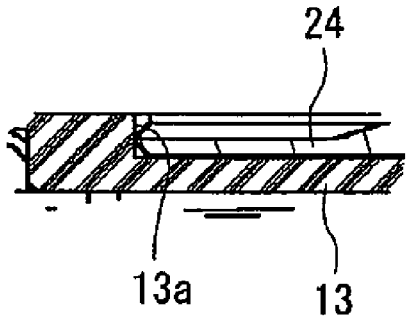
FIG. 23B is an enlarged view of area 23B in FIG. 22.

When the circuit unit 10 is caused to advance further from the state shown in FIGS. 18-20B, the first connector 12 and the second connector 30 are positioned in a final mating position, as shown in FIGS. 21-23B. In this position, the first connector housing 13 is guided along the inner walls of the first connector housing receiving recess 23 of the cover member 21, while the circuit unit housing 11 is guided along the inner walls of the circuit unit housing receiving recess 22 of the cover member 21. The second connector 30 is retracted to a position in the vicinity of the rearmost end of the connector accommodating member 24. The bottom portion of the recess 13*a* of the first connector housing 13 of the first connector 12 contacts the front end surface of the connector accommodating member 24 provided in the cover member 21, as shown in FIGS. 23A-23B. The locking members 16 of the first connector 12 have ridden over the locking projections 33 of the second connector 30, and the locking projections 33 have entered the openings 16*a*, so that the state of locking between the first connector 12 and the second connector 30 is maintained. Moreover, the state of contact between the contacts (not shown) provided on the first connector 12 and the contacts (not shown) provided on the second connector 30 is maintained. As a result of the circuit unit 10 being inserted into the final mating position, the mating of the circuit unit 10 and the electrical connector 20 is complete.

In the mating process of the circuit unit 10 and the electrical connector 20, the locking of the first connector 12 and the second connector 30 is completed, as shown in FIGS. 12-14D. After the mating of the first connector 12 and the second connector 30 is completed, the release of the locking of the second locking projections 32 of the second connector 30 by the first locking projections 26 is initiated by the first lock release projections 17 and the second lock release projections 27, as shown in FIGS. 15-17D, and completed, as shown in FIGS. 18-20B. Accordingly, there is no half-mating of the first connector 12 with the second connector 30. In other words, when the circuit unit 10 is inserted into the final mating position shown in FIGS. 21-23B, the mating of the first connector 12 and the second connector 30 has already been completed. Consequently, the electrical connector 20 is capable of reliably preventing half-mating between the first connector 12 and the second connector 30 that is accommodated inside the cover member 21. Moreover, when the mating between the circuit unit 10 and the electrical connector 20 is to be released, the circuit unit 10 is pulled in the direction opposite from the direction of arrow X shown in FIGS. 4-5 from the state shown in FIGS. 21-22 to cause the circuit unit 10 to be retracted. As a result, an operation that is opposite from the operation shown in FIGS. 4-23B is performed, so that the mating between the circuit unit 10 and the electrical connector 20 is released, as shown in FIGS. 4-5.

FIGS. 24-37 show a connector device 51 consisting of a second embodiment of an electrical connector 70 according to the invention and a circuit unit 60 that mates with and is electrically connected thereto. As shown in FIGS. 25-26, the circuit unit 60 comprises a substantially square circuit unit housing 61 and a first connector 62. As shown in FIG. 26, unlike the circuit unit 10 shown in FIGS. 1-2, the circuit unit 60 has an inclined member 61*a* formed on an upper surface thereof so that a front side (right side in FIG. 26) of the circuit unit housing 61 is wider than a rear side of the circuit unit housing 61. The first connector 62 has a substantially square first connector housing 63 and is fastened to a front end of the circuit unit housing 61. The first connector housing 63 has a width substantially the same as the width of the circuit unit housing 61, as shown in FIG. 26. A recess 63*a* is formed in the first connector housing 63 and opens on a front surface of the first connector housing 63. As shown in FIG. 25, a substantially rectangular contact fastening member 64 that extends in the direction of width of the first connector housing 63 is formed on the inside of the recess 63*a* so that the contact fastening member 64 protrudes forward from a bottom of the recess 63*a*. A plurality of rows of contacts 68 are attached to the contact fastening member 64.

A pair of circuit board fastening members 65 for fastening the first connector housing 63 to the surface of a circuit board PCB fastened inside the circuit unit housing 61 is provided on a rear end of the first connector housing 63. Rear end portions of the contacts 68 are electrically connected to the circuit board PCB, for example, by soldering or the like. Locking members 66 are provided on upper and lower surfaces of the contact fastening member 64 so that the locking members 66 protrude forward there from. An opening 66*a* is formed in each of the locking members 66. First lock release projections 67 are provided on side surfaces of the contact fastening member 64 in the direction of width at two ends thereof. Pressing projections 69 are provided on the inner surfaces of upper and lower walls of the first connector housing 6 in substantially a center thereof.

Figure 24:
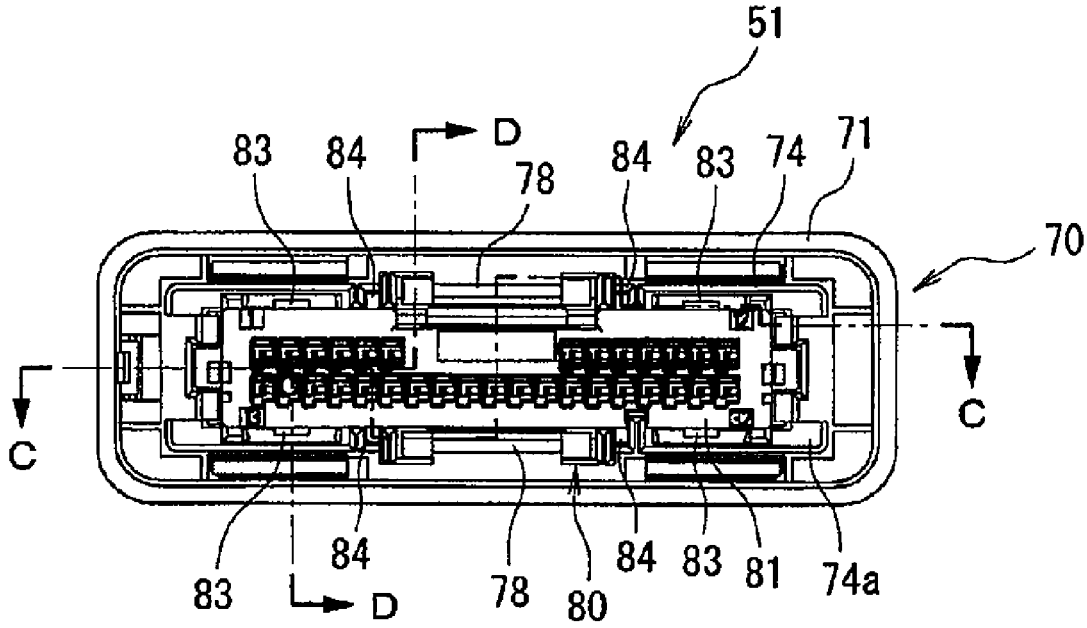
FIG. 24 is a rear view of a connector device consisting of a second embodiment of an electrical connector according to the invention and a circuit unit that mates with and is electrically connected thereto shown from a back side of the electrical connector.
Figure 25:
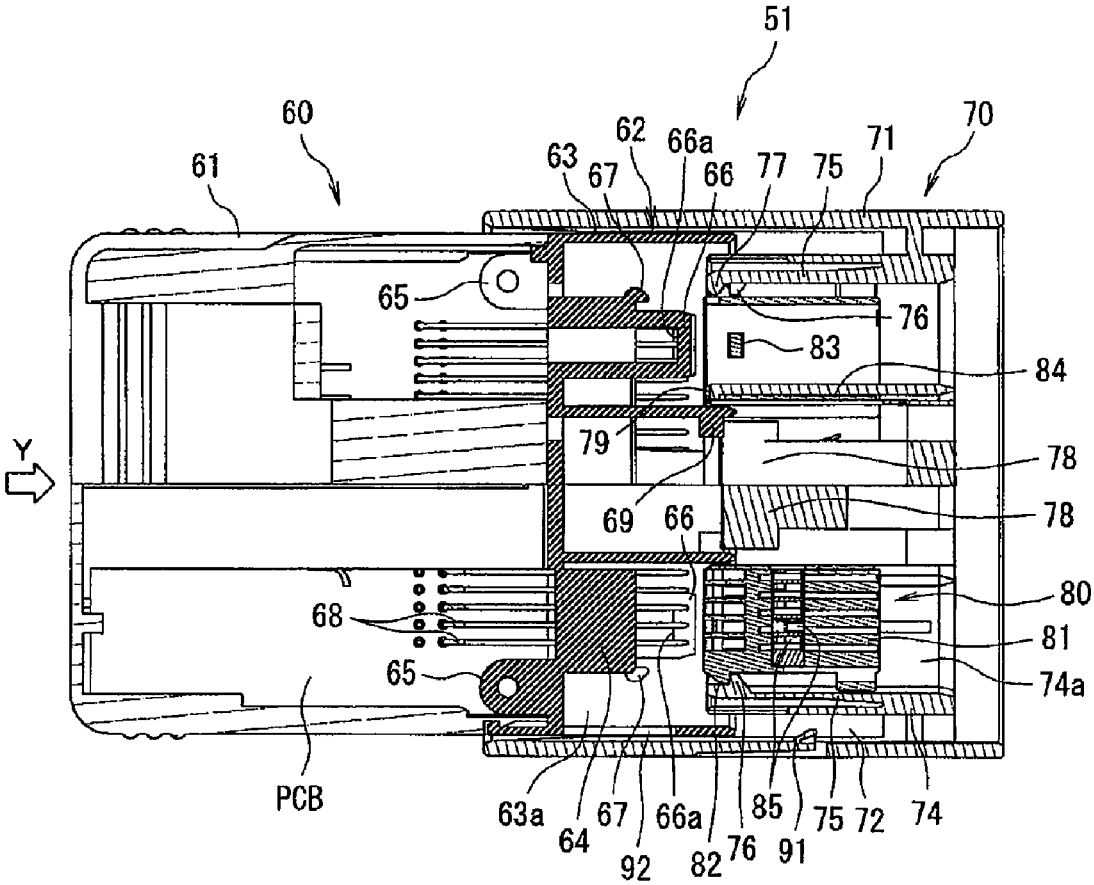
FIG. 25 is a sectional view along line C-C in FIG. 24 showing an initial mating position between the circuit unit and electrical connector.
Figure 26:
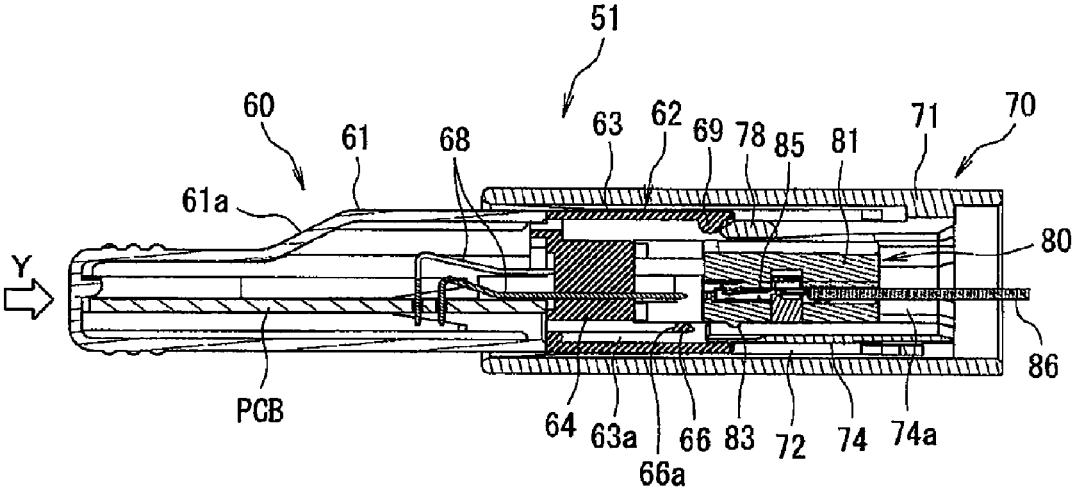
FIG. 26 is a sectional view along line D-D in FIG. 24 showing the initial mating position between the circuit unit and electrical connector.

As shown in FIGS. 24-26, the electrical connector 70 is a receptacle electrical connector and comprises a cover member cover member 71 and a second connector 80. As shown in FIG. 25, the cover member 71 has a substantially square shape. A circuit unit receiving recess 72 that receives the first connector 62 and the circuit unit housing 61 of the circuit unit 60 is formed in an interior of the cover member 71 so that the circuit unit receiving recess 72 opens on a front surface (left side in FIG. 25) of the cover member 71. A substantially rectangular connector accommodating member 74 that accommodates the second connector 80 is formed at a rear of the circuit unit receiving recess 72. A through-hole 74*a* that extends in a forward-rearward direction of the cover member 71 is provided in the interior of the connector accommodating member 74 and is configured to receive the second connector 80. Latch arms 75 are provided on side walls of the connector accommodating member 74 in the direction of width. The latch arms 75 have a substantially cantilever shape and extend forward from a rear portion of the side walls of the connector accommodating member 74 in the direction of width so that tip ends of the latch arms 75 protrude into the through-hole 74*a*. First locking projections 76 for locking the second connector 80 inside the connector accommodating member 74 are formed at the tip ends of the latch arms 75 in a substantial center thereof in a vertical direction so that the first locking projections 76 protrude into the through-hole 74*a*. Second lock release projections 77 for releasing the locking of the second connector 80 by the first locking projections 76 are formed at the tip ends of the latch arms 75 at upper and lower ends thereof in the vertical direction so that the second lock release projections 77 protrude into the through-hole 74*a*. As shown in FIG. 25, stopper projections 79 are provided on upper and lower walls of the connector accommodating member 74 at front end portions thereof. As shown in FIGS. 25-26, substantially cantilever support arms 78 that extend from a vicinity of the rear end portion of the connector accommodating member 74 to a vicinity of the front end portion of the connector accommodating member 74 are provided on upper and lower walls of the cover member 71.

As shown in FIGS. 24-26, the second connector 80 comprises a substantially rectangular second connector housing 81. Contacts 85 are attached to the second connector housing 81 in a plurality of rows and make contact with the contacts 68 of the first connector 62 in front portions thereof. The contacts 85 are connected to a wire harness or electrical wires 86 in the rear portions thereof, as shown in FIG. 26. The second connector 80 is designed to be accommodated inside the through-hole 74*a* in the connector accommodating member 74 of the cover member 71 from a rear of the cover member 71 after being attached to one end of the electrical wires 86. Second locking projections 82 that engage with the first locking projections 76 provided on the connector accommodating member 74 are formed on end surfaces in the direction of width of the second connector housing 81. As shown in FIG. 25, the second locking projections 82 ride over the first locking projections 76 and are positioned in front of the first locking projections 76. When the second locking projections 82 are positioned in front of the first locking projections 76, rearward movement of the second connector 80 is restricted. When the second locking projections 82 ride over the first locking projections 76 in this manner, the front end surface of the second connector housing 81 of the second connector 80 is located in a position that substantially coincides with the front end surface of the connector accommodating member 74.

Figure 30:
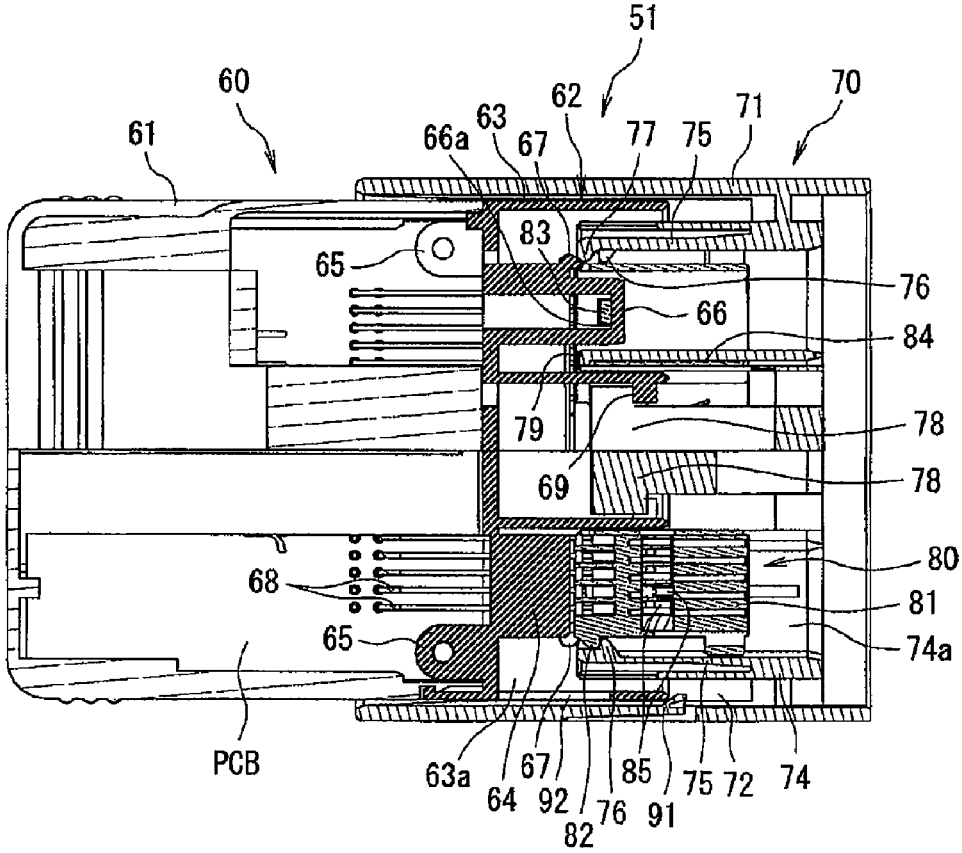
FIG. 30 is a sectional view along line C-C in FIG. 24 showing a mating position between the first connector and the second connector.

As shown in FIGS. 24-25, projecting ribs 84 that extend in a forward-rearward direction protrude from upper and lower surfaces of the second connector housing 81 of the second connector 80. As shown in FIG. 25, the projecting ribs 84 are configured such that forward movement of the second connector 80 is restricted by the front end surfaces of the projecting ribs 84 contacting the rear end surfaces of the stopper projections 79 provided on the connector accommodating member 74. As shown in FIG. 30, locking projections 83 are formed so as to protrude from front end portions of upper and lower surfaces of the second connector housing 81 of the second connector 80. The locking projections 83 are configured to enter the openings 66*a* of the locking members 66 of the first connector 62 to lock the first connector 62 to the second connector 80.

Figure 36:
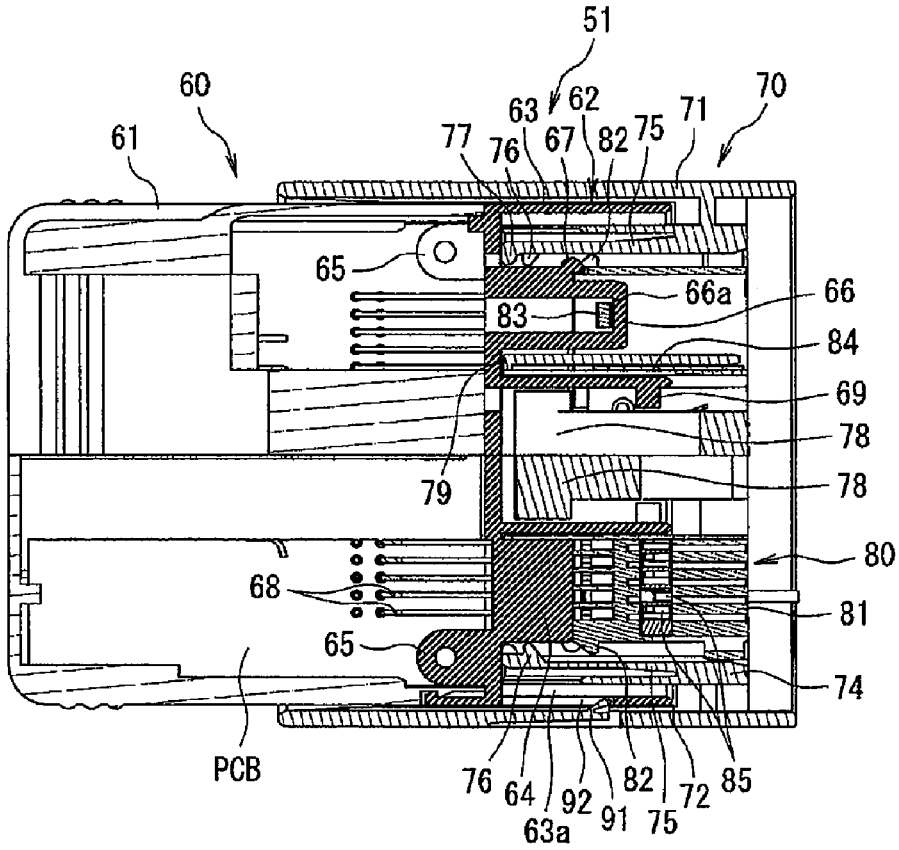
FIG. 36 is a sectional view along line C-C in FIG. 24 showing a final mating position between the first connector and the second connector.

Unlike the electrical connector 20 of the first embodiment, the electrical connector 70 has substantially cantilever holding arms 91 provided on side walls of the cover member 71, as shown in FIG. 25. The holding arms 91 are configured for holding the circuit unit 60 in the cover member 71 when the circuit unit 60 is inserted into a final mating position, as shown in FIG. 36. The holding arms 91 extend rearward from fixed ends thereof. Locking projections that protrude into the circuit unit receiving recess 72 are provided at tip ends of the holding arms 91. As shown in FIG. 36, when the circuit unit 60 is inserted into the final mating position, the locking projections of the holding arms 91 enter into and lock in opening members 92 formed in side walls of the first connector housing 63 of the first connector 62, so that the circuit unit 60 is held in the cover member 71.

The mating of the circuit unit 60 and the electrical connector 70 will now be described. As shown in FIGS. 25-26, the circuit unit 60 is advance in a direction of arrow Y from the state shown in FIGS. 25-26 in which the circuit unit 60 and the electrical connector 70 are not mated, so that the first connector housing 63 is inserted into the circuit unit receiving recess 72 in the cover member 71. The first connector housing 63 is guided along the inner walls of the circuit unit receiving recess 72. Accordingly, the first connector 62 and the second connector 80 mate with each other. Because the axes of the first connector 62 and the second connector 80 are aligned, mating can be accomplished in one operation.

If the circuit unit 60 is inserted into the cover member 71 from a side opposite from the side where the first connector 62 is located, then because the rear portion of the circuit unit housing 61 has a smaller width than the front portion, the circuit unit 60 cannot be guided smoothly along the inner walls of the circuit unit receiving recess 72. Consequently, erroneous insertion with the front and rear of the circuit unit 60 being reversed can be easily detected.

FIGS. 25-26 show the first connector 62 and the second connector 80 in an initial mating position. In this position, the second locking projections 82 of the second connector 80 are located in front of the first locking projections 76 and are therefore placed in a locked state. Accordingly, the rearward movement of the second connector 80 is restricted. Additionally, in this position, as shown in FIG. 26, the pressing projections 69 provided on the first connector 62 contact the support arms 78 provided on the cover member 71. Further, in this position, the contacts 68 provided on the first connector 62 and the contacts 85 provided on the second connector 80 have not yet come into contact.

Figure 27:
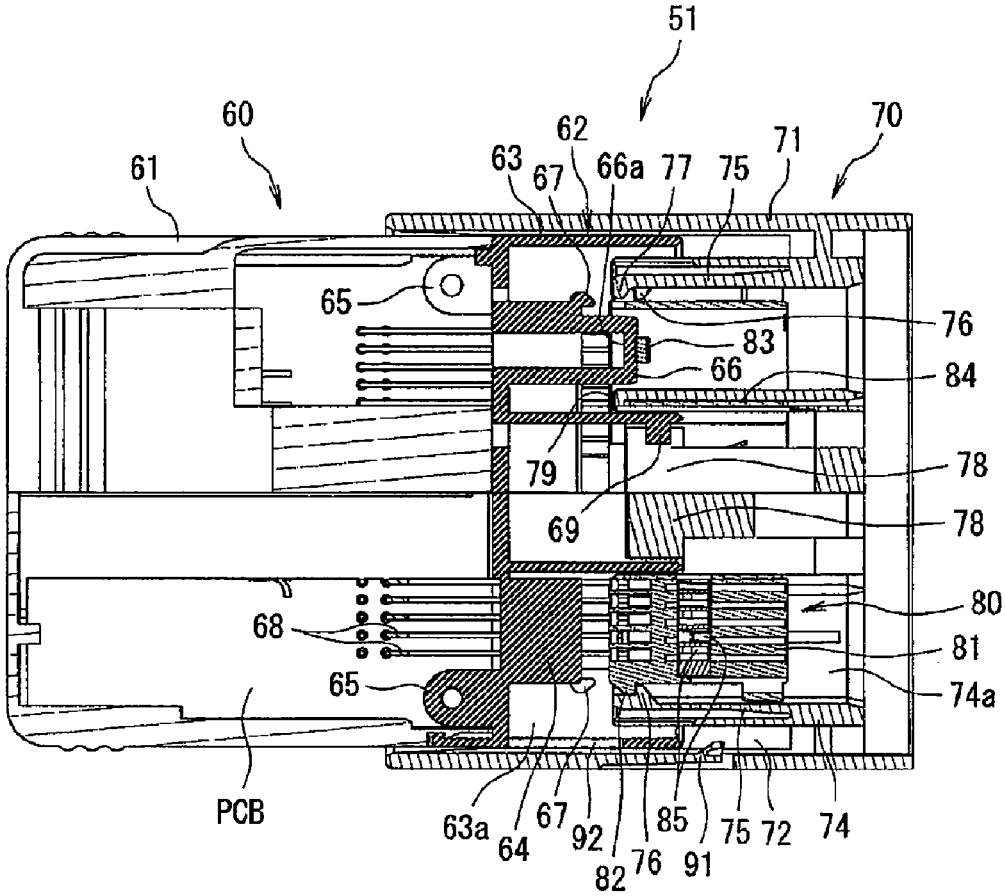
FIG. 27 is a sectional view along line C-C in FIG. 24 showing an intermediate mating position between the first connector and second connector.
Figure 28:
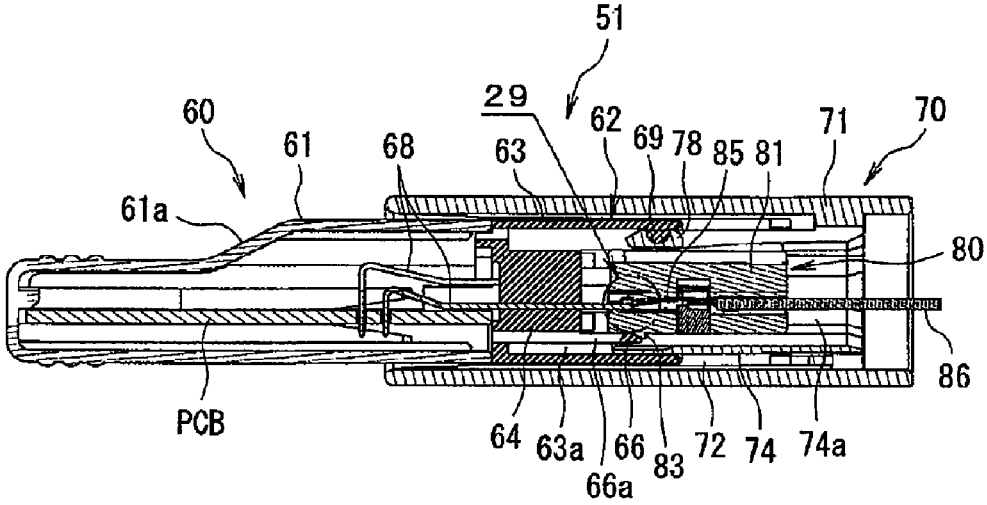
FIG. 28 is a sectional view along line D-D in FIG. 24 showing the intermediate mating position between the first connector and second connector.
Figure 29:
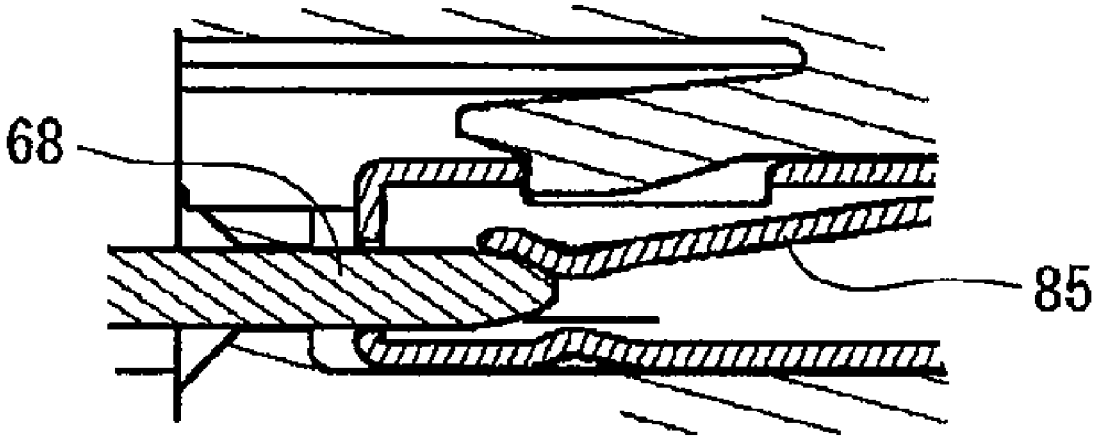
FIG. 29 is an enlarged view of area 29 in FIG. 28.

When the circuit unit 60 is caused to advance further from the state shown in FIGS. 25-26, the first connector 62 and the second connector 80 are placed in an intermediate mating position, as shown in FIGS. 27-29. In this position, the first connector housing 63 and the circuit unit housing 61 are guided along the inner walls of the circuit unit receiving recess 72. In this position, as shown in FIG. 28, the pressing projections 69 provided on the upper side of the first connector 62 press the support arm 78 provided on the upper side of the cover member 71 in a downward direction, and the pressing projections 69 provided on the lower side of the first connector 62 press the support arm 78 provided on the lower side of the cover member 71 in an upward direction, so that the second connector 80 is arranged between the support arms 78 and is secured in place. As shown in FIG. 27, the second locking projections 82 of the second connector 80 are still positioned in front of the first locking projections 76 and are therefore placed in a locked state, thus restricting the rearward movement of the second connector 80. In this position, the locking members 66 of the first connector 62 make contact with the locking projections 83 of the second connector 80, as shown in FIG. 28. Moreover, the contacts 68 provided on the first connector 62 and the contacts 85 provided on the second connector 80 come into contact, as shown in FIG. 29. Because the second connector 80 is fastened in place by the support arms 78 when the contacts 68, 85 come into contact, the contact between the contacts 68, 85 is reliably accomplished. As a result, the circuit unit 60 and the electrical connector 70 are electrically connected.

Figure 31:
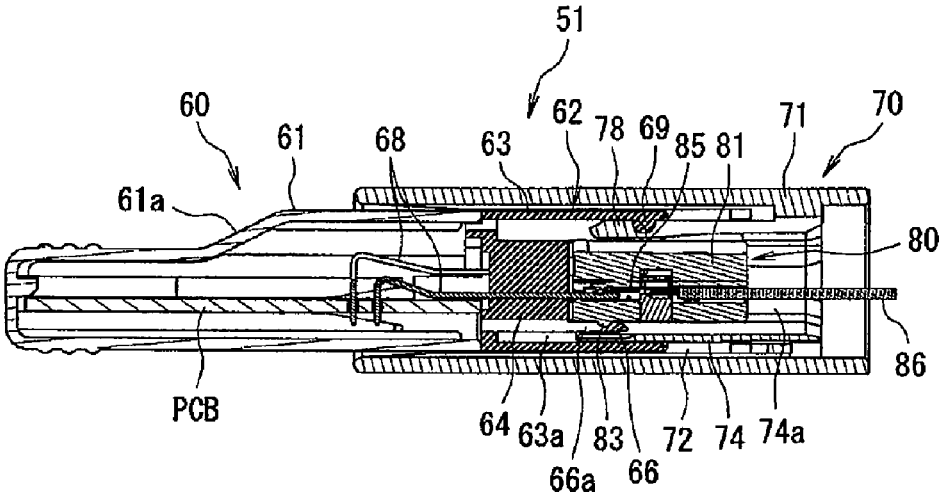
FIG. 31 is a sectional view along line D-D in FIG. 24 showing the mating position between the first connector and the second connector.

When the circuit unit 60 is caused to advance further from the state shown in FIGS. 27-29, the first connector 62 and the second connector 80 are placed in a mating position, as shown in FIGS. 30-31. In the mating position, the mating between the first connector 62 and the second connector 80 has been completed. In this position, the first connector housing 63 of the first connector 62 and the circuit unit housing 61 of the circuit unit 60 are guided along the inner walls of the circuit unit receiving recess 72. As shown in FIG. 31, the pressing projections 69 provided on the upper side of the first connector 62 still press the support arm 78 provided on the upper side of the cover member 71 in the downward direction and the pressing projections 69 provided on the lower side of the first connector 62 still press the support arm 78 provided on the lower side of the cover member 71 in the upward direction, thus positioning the second connector 80 between the support arms 78 and securing the second connector 80 in place. As shown in FIG. 30, the second locking projections 82 of the second connector 80 are still positioned in front of the first locking projections 76 and are therefore still placed in a locked state, so that the rearward movement of the second connector 80 is still restricted. As shown in FIG. 31, the locking members 66 of the first connector 62 ride over the locking projections 83 of the second connector 80 and the locking projections 83 enter the openings 66*a*, thus completing the locking of the first connector 62 and the second connector 80. In this position, the first lock release projections 67 provided on the first connector 62 contact the second lock release projections 77 provided on the latch arms 75 of the cover member 71, as shown in FIG. 30.

Figure 32:
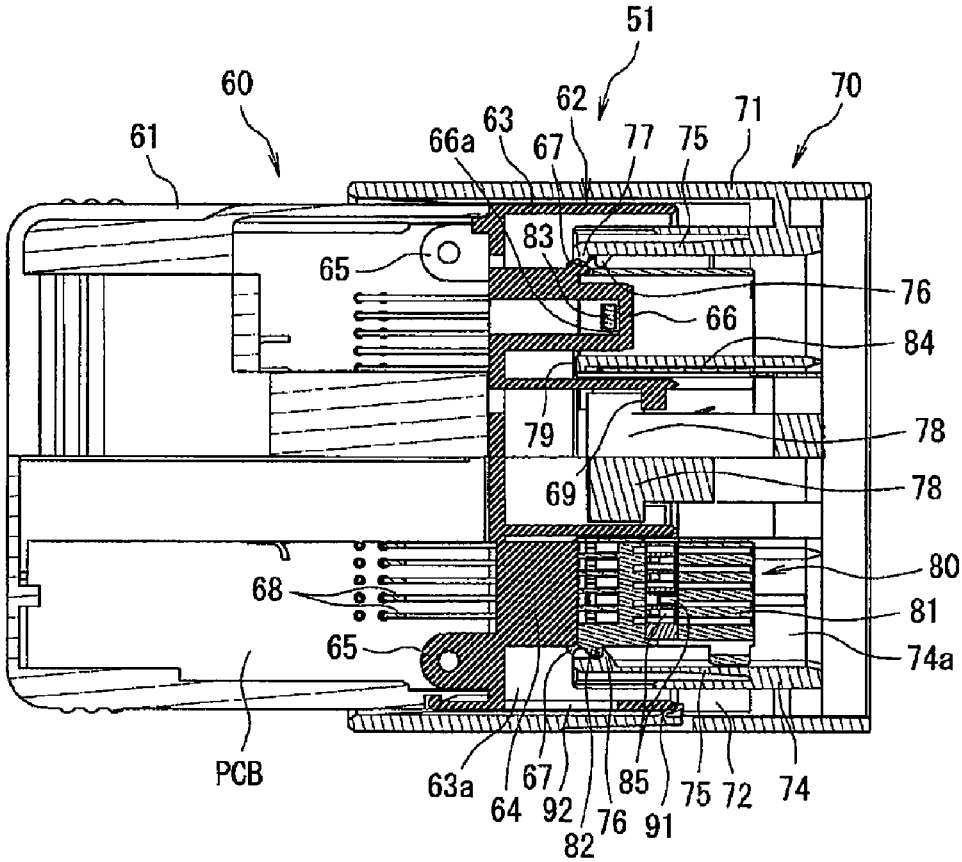
FIG. 32 is a sectional view along line C-C in FIG. 24 showing a state in which the release of the locking of the second connector has been initiated following the completion of the mating between the first connector and the second connector.
Figure 33:
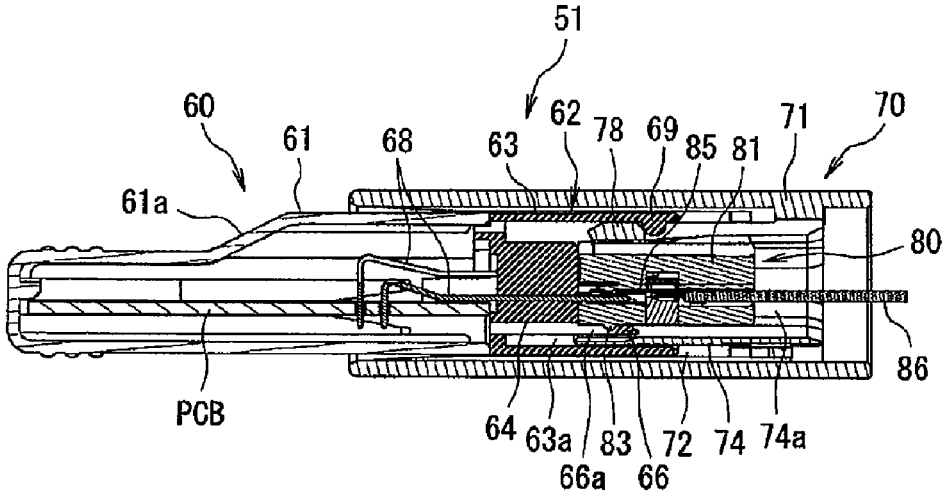
FIG. 33 is a sectional view along line D-D in FIG. 24 showing the state in which the release of the locking of the second connector has been initiated following the completion of the mating between the first connector and the second connector.

When the circuit unit 60 is caused to advance further from the state shown in FIGS. 30-31, a state is created in which the circuit unit 60 is inserted further into the electrical connector 70, as shown in FIGS. 32-33. In this position, the first connector housing 63 of the first connector 62 and the circuit unit housing 61 of the circuit unit 60 are guided along the inner walls of the circuit unit receiving recess 72. As shown in FIG. 33, the pressing of the support arm 78 by the pressing projections 69 provided on the upper side of the first connector 62 is released, and the pressing of the support arm 78 by the pressing projections 69 provided on the lower side of the first connector 62 is released. As shown in FIG. 32, the first lock release projections 67 press-open the latch arms 75 via the second lock release projections 77 provided on the latch arms 75. As a result, the release of the locking of the second connector 80 by the first locking projections 76 is initiated. Specifically, as shown in FIG. 32, as a result of the latch arm 75 being pressed-open, the first projection 76 provided on the latch arm 75 also moves, thus initiating the release of the locking of the second projection 82 provided on the second connector 80 by the first projection 76. As shown in FIG. 33, the locking members 66 of the first connector 62 have ridden over the locking projections 83 of the second connector 80, and the locking projections 83 have entered the openings 66*a*, so that the state of locking between the first connector 62 and the second connector 80 is maintained.

Figure 34:
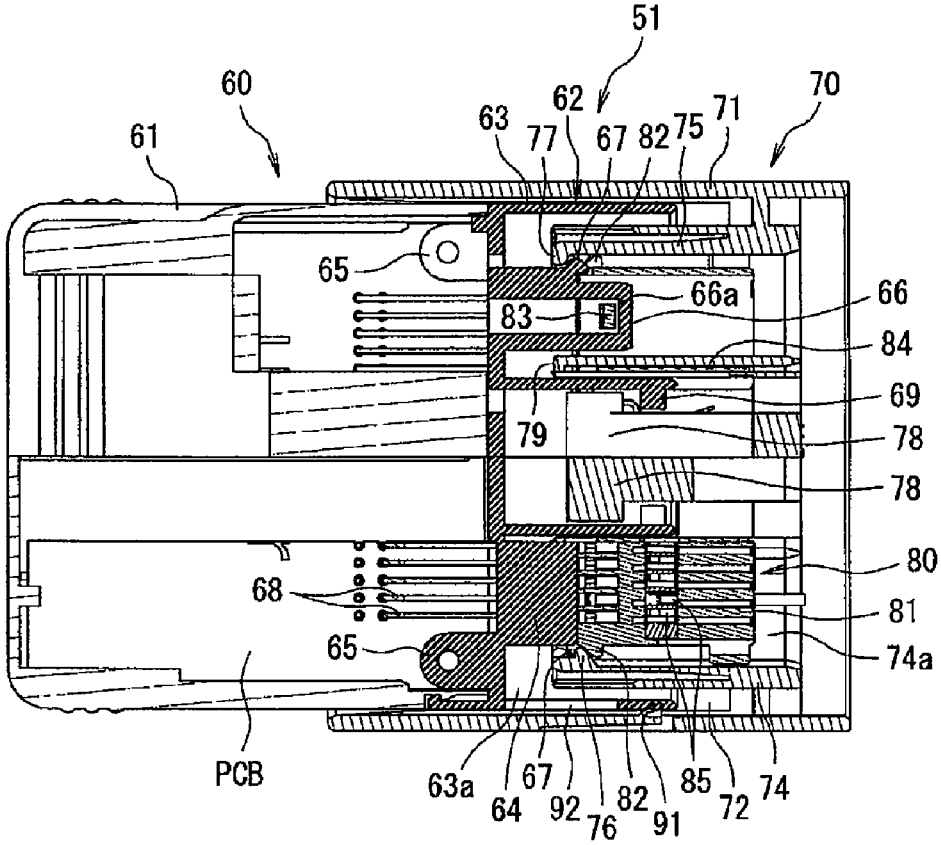
FIG. 34 is a sectional view along line C-C in FIG. 24 showing a state in which the release of the locking of the second connector has been completed.
Figure 35:
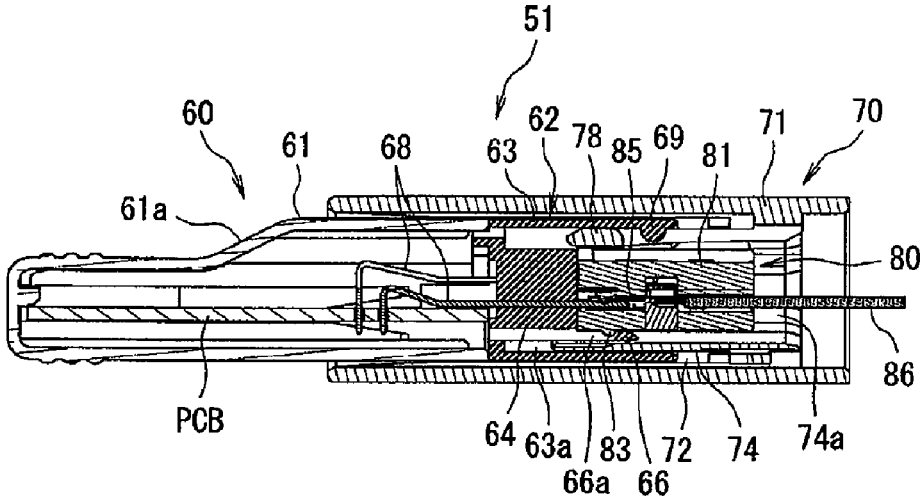
FIG. 35 is a sectional view along line D-D in FIG. 24 showing the state in which the release of the locking of the second connector has been completed.

When the circuit unit 60 is caused to advance further from the state shown in FIGS. 32-33, a state is created in which the circuit unit 60 is inserted further into the electrical connector 70 from the mating position, as shown in FIGS. 34-35. In this position, the first connector housing 63 of the first connector 62 and the circuit unit housing 61 of the circuit unit 60 are guided along the inner walls of the circuit unit receiving recess 72. As shown in FIG. 34, the first lock release projections 67 have ridden over the second lock release projections 77 provided on the latch arm 75, and the latch arm 75 returns to its original position. As shown in FIG. 34, the second projection 82 moves rearward together with the second connector 80 and is positioned on the rear side of the first projection 76 provided on the latch arm 75. As a result, the release of the locking of the second connector 80 by the first locking projections 76 is completed. As shown in FIG. 34, the locking projections of the holding arms 91 provided on the side walls of the cover member 71 ride on the side walls of the first connector housing 63 of the first connector 62. As shown in FIG. 35, the locking members 66 of the first connector 62 have ridden over the locking projections 83 of the second connector 80, and the locking projections 83 have entered the openings 66*a*, so that the state of locking between the first connector 62 and the second connector 80 is maintained. When the release of the locking of the second connector 80 by the locking projections 76 is completed, the second connector 80 can slide in the direction of insertion and removal of the circuit unit inside the connector accommodating member 74.

Figure 37:
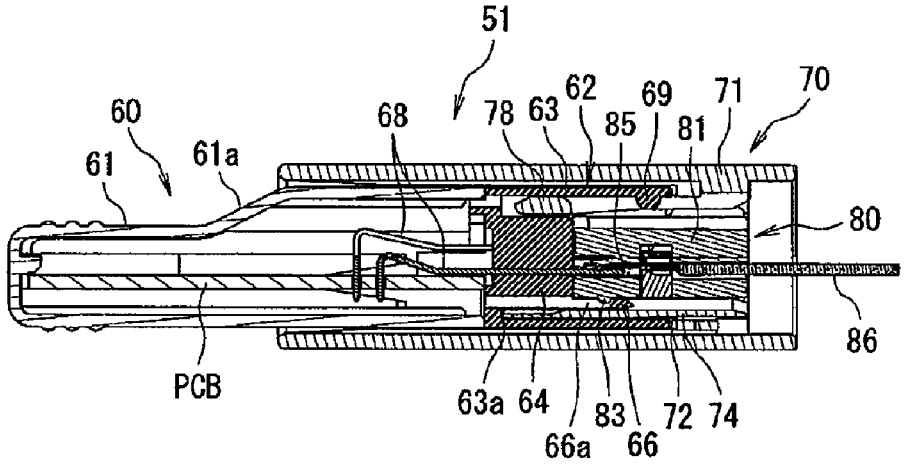
FIG. 37 is a sectional view along line D-D in FIG. 24 showing the final mating position between the first connector and the second connector.
Figure 38:
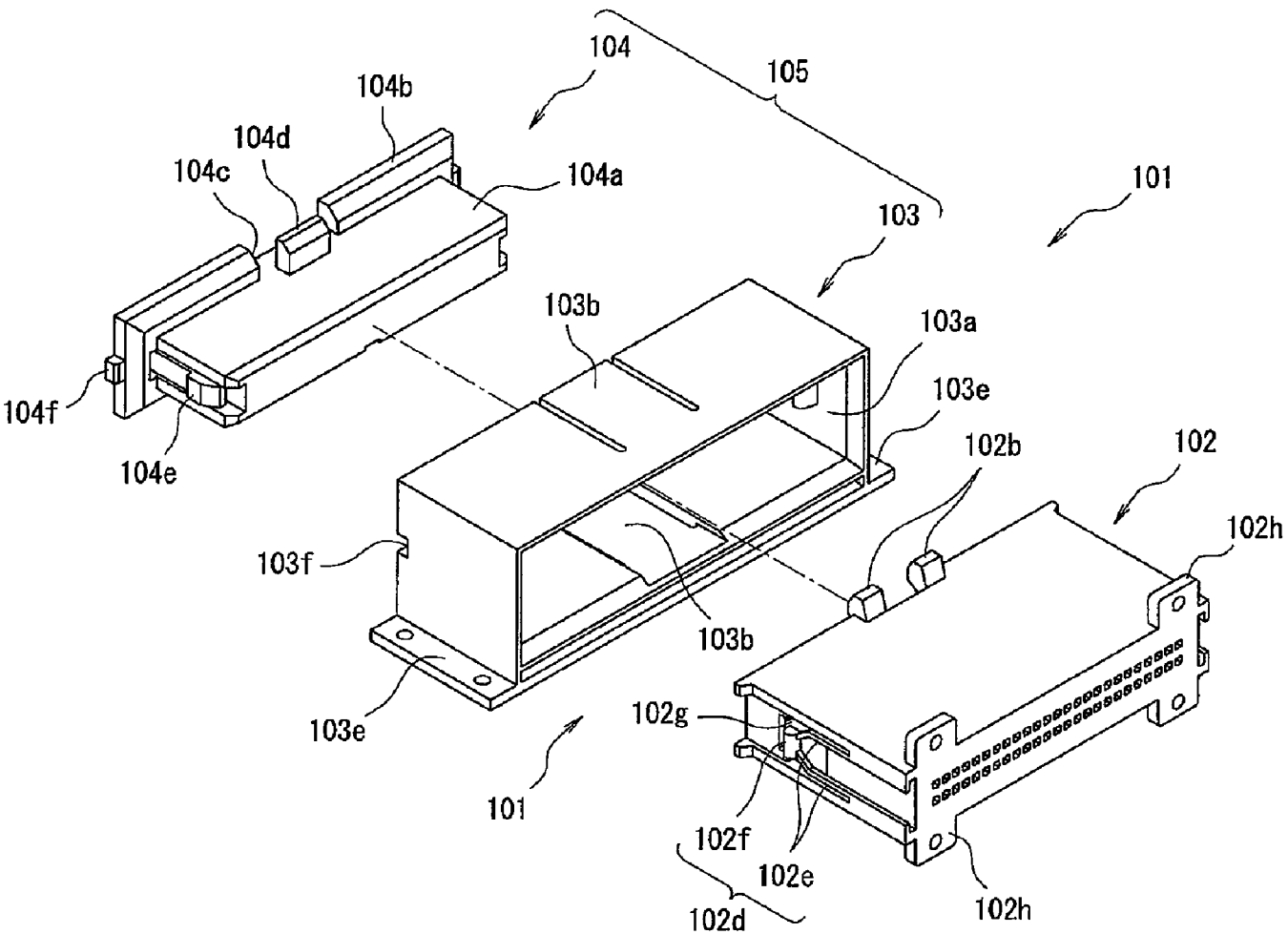
PRIOR ART FIG. 38
FIG. 38 is a perspective exploded view of a connector device according to the prior art.
Figure 39:
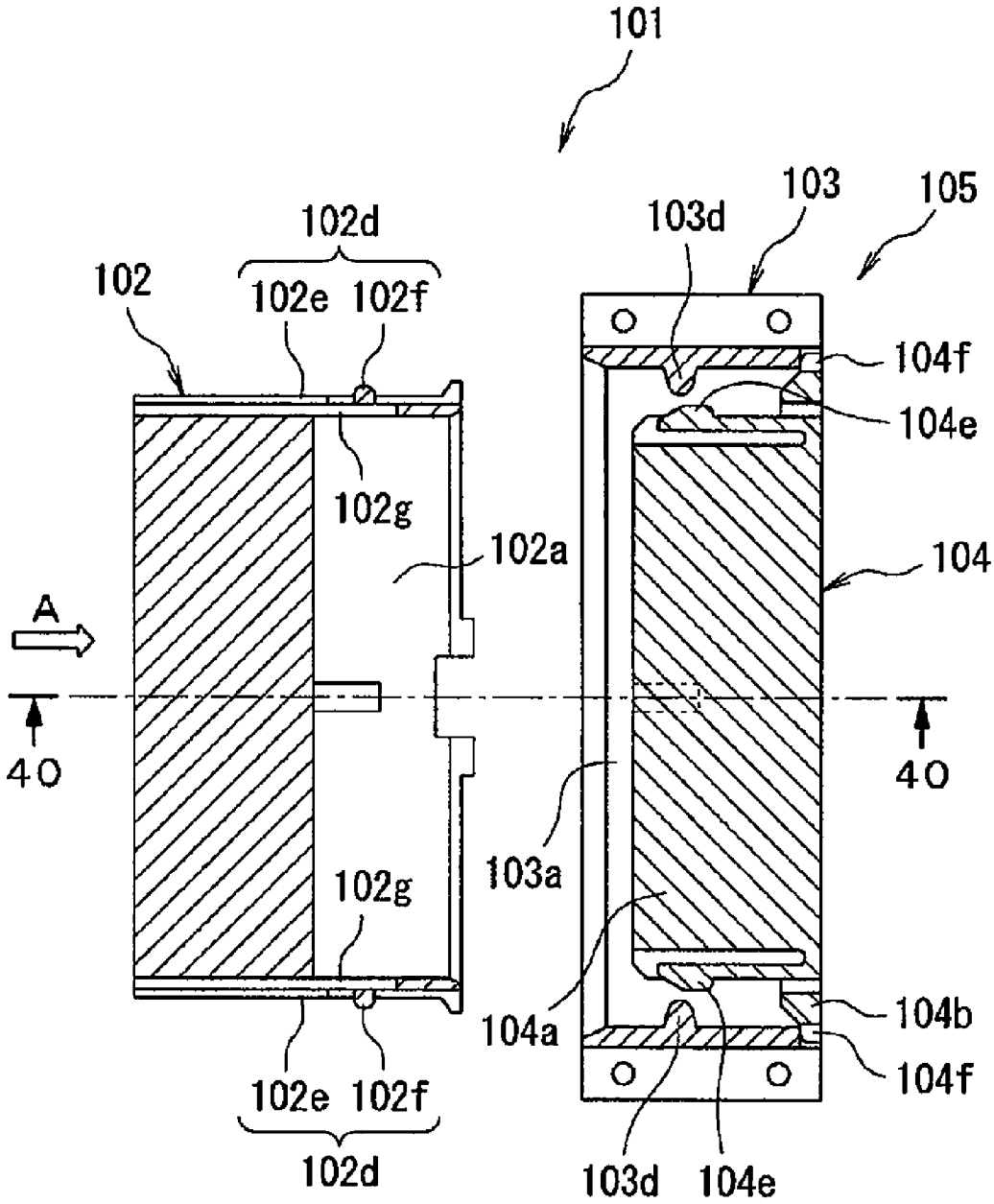
PRIOR ART FIG. 39
FIG. 39 is a sectional view of the connector device shown in FIG. 38 showing a first connector and a second connector consisting of a connector member accommodated in a receptacle member.
Figure 40:
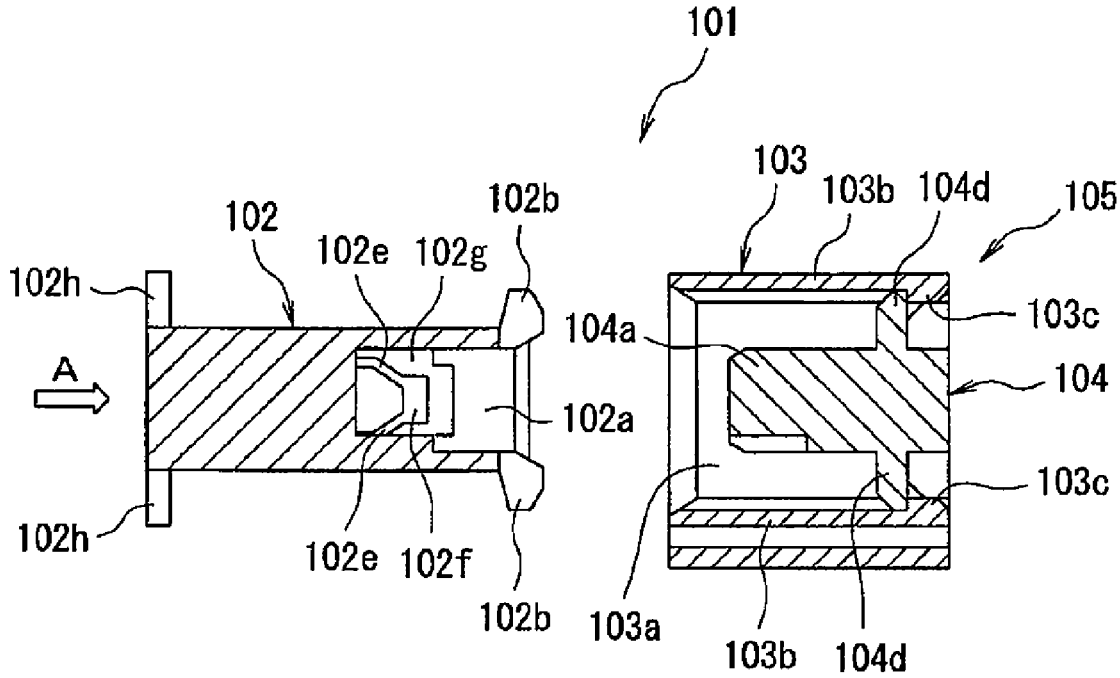
PRIOR ART FIG. 40
FIG. 40 is a sectional view along line 40-40 in FIG. 39.
Figure 41:
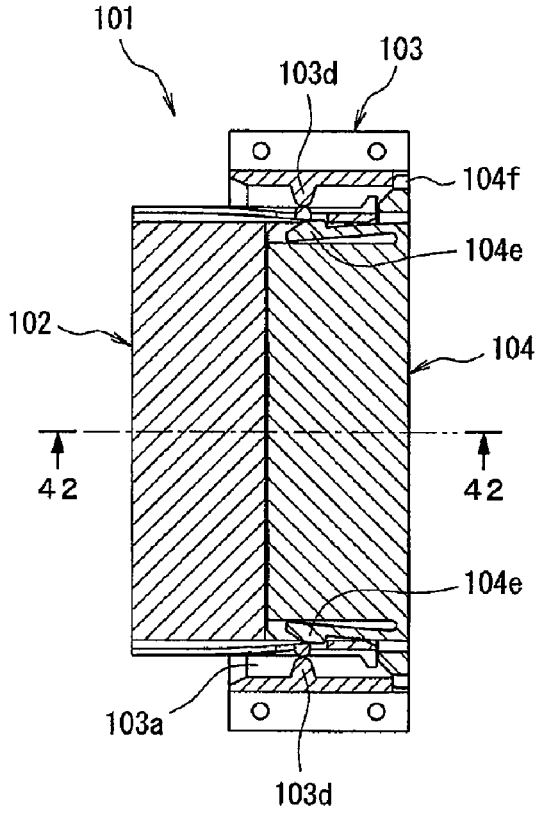
PRIOR ART FIG. 41
FIG. 41 is sectional view of the connector device shown in FIG. 40 at an intermediate point during mating.
Figure 42:
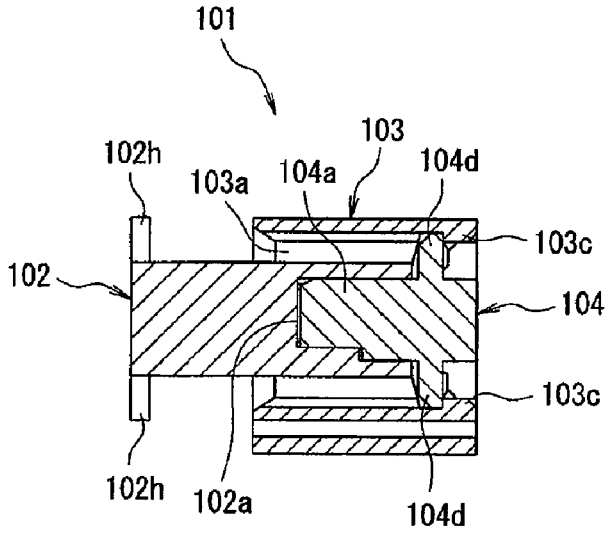
PRIOR ART FIG. 42
FIG. 42 is a sectional view along line 42-42 in FIG. 41.
Figure 43:
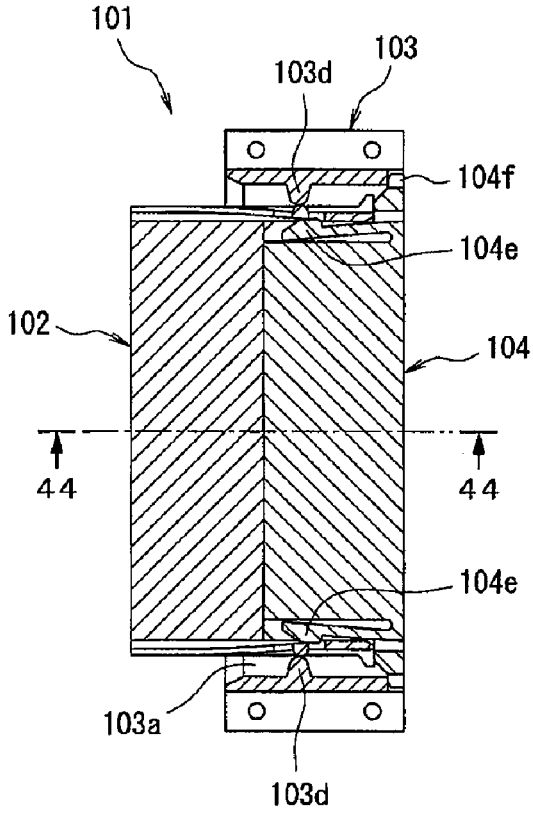
PRIOR ART FIG. 43
FIG. 43 is sectional view of the connector device shown in FIG. 41 at an intermediate point during mating.
Figure 44:
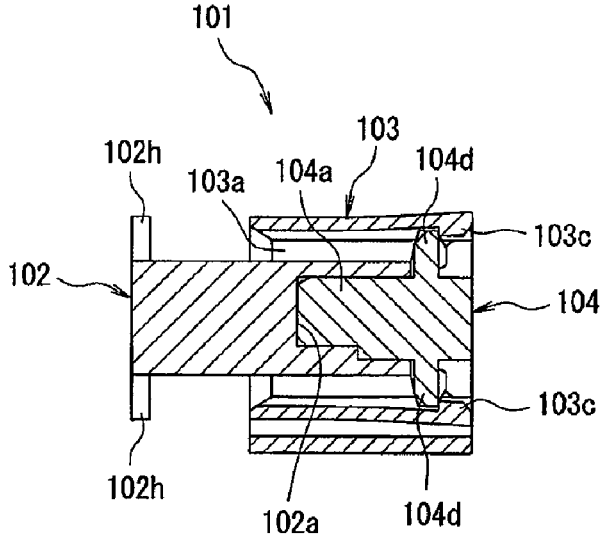
PRIOR ART FIG. 44
FIG. 44 is a sectional view along line 44-44 in FIG. 43.
Figure 45:
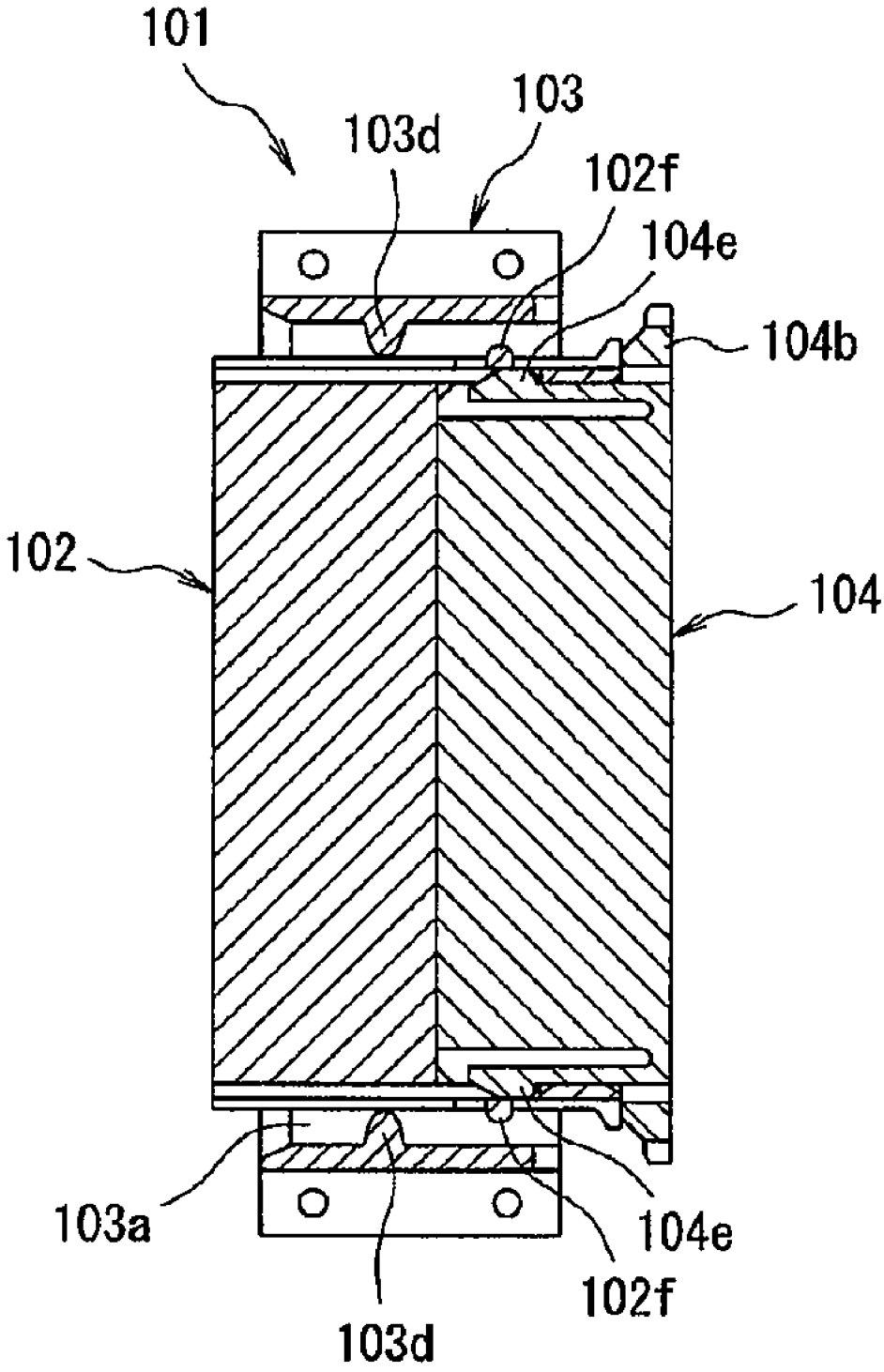
PRIOR ART FIG. 45
FIG. 45 is sectional view of the completed state of mating of the connector device shown in FIG. 43.
Figure 46A:
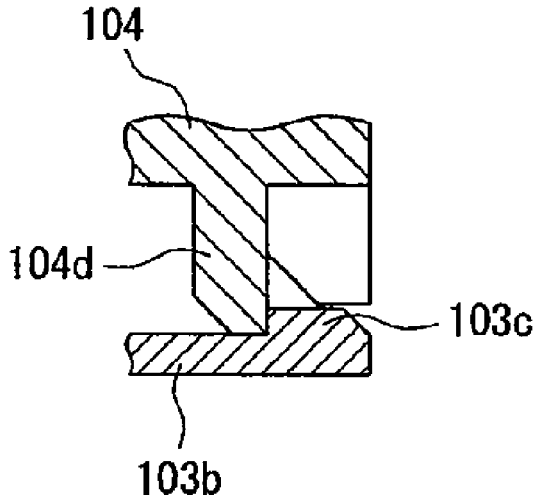
PRIOR ART FIG. 46A
FIG. 46A is a first exploded sectional view showing the relationship between a locking member and a lock release member in the connector device of FIG. 38.
Figure 46B:
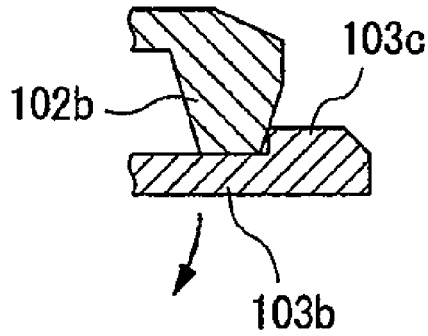
PRIOR ART FIG. 46B
FIG. 46B is a second exploded sectional view showing the relationship between a locking member and a lock release member in the connector device of FIG. 38.
Figure 46C:
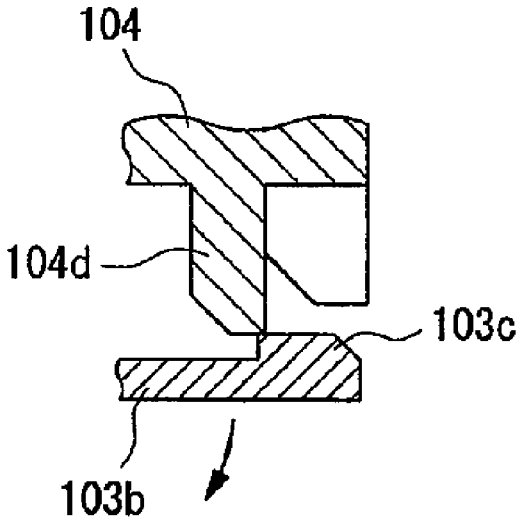
PRIOR ART FIG. 46C
FIG. 46C is a third exploded sectional view showing the relationship between a locking member and a lock release member in the connector device of FIG. 38.
Figure 46D:
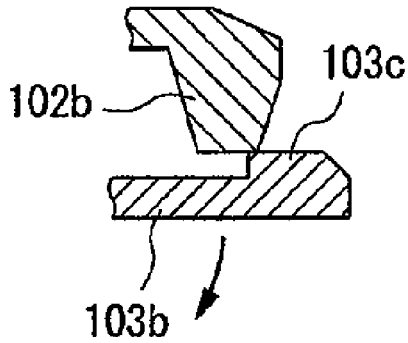
PRIOR ART FIG. 46D
FIG. 46D is a fourth exploded sectional view showing the relationship between a locking member and a lock release member in the connector device of FIG. 38.
Figure 47A:
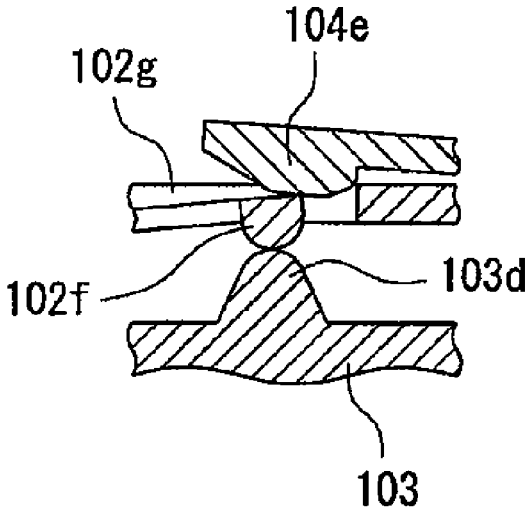
PRIOR ART FIG. 47A
FIG. 47A is a first exploded sectional view showing the relationship between locking member and a lock release member for locking the first connector and the second connector.
Figure 47B:
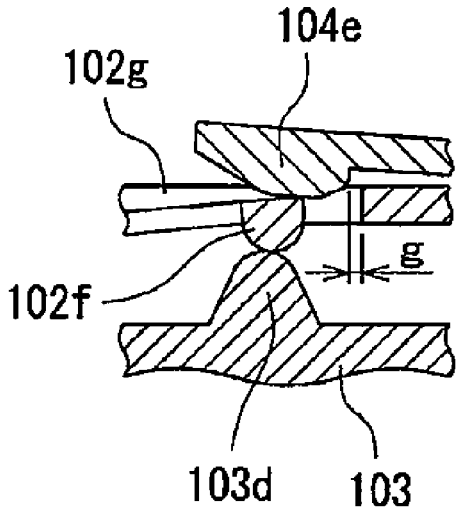
PRIOR ART FIG. 47B
FIG. 47B is a second exploded sectional view showing the relationship between locking member and a lock release member for locking the first connector and the second connector.
Figure 47C:
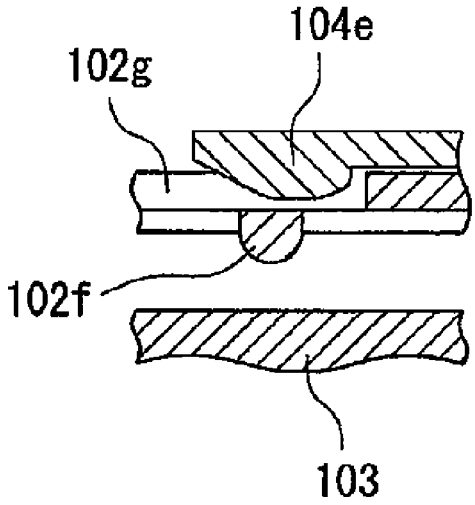
PRIOR ART FIG. 47C
FIG. 47C is a third exploded sectional view showing the relationship between locking member and a lock release member for locking the first connector and the second connector.

When the circuit unit 60 is caused to advance further from the state shown in FIGS. 34-35, the first connector 62 and the second connector 80 are positioned in a final mating position, as shown in FIGS. 36-37. In this position, the first connector housing 63 of the first connector 62 and the circuit unit housing 61 of the circuit unit 60 are guided along the inner walls of the circuit unit receiving recess 72. The second connector 80 is retracted to a position in the vicinity of the rearmost end of the connector accommodating member 74. The bottom portion of the recess 63*a* of the first connector housing 63 of the first connector 62 contacts the front end surface of the connector accommodating member 74 provided in the cover member 71, as shown in FIGS. 36-37. As shown in FIG. 36, the locking projections of the holding arms 91 provided on the side walls of the cover member 71 enter into and lock in the opening members 92 formed in the first connector housing 63 of the first connector 62, thus holding the circuit unit 60 in the cover member 71. Accordingly, there is no need to provide a separate circuit unit holding member for holding the circuit unit 60. Furthermore, the locking members 66 of the first connector 62 have ridden over the locking projections 83 of the second connector 80, and the locking projections 83 have entered the openings 66*a*, so that the state of locking between the first connector 62 and the second connector 80 is maintained. Moreover, the state of contact between the contacts 68 provided on the first connector 62 and the contacts 85 provided on the second connector 80 is maintained. As a result of the circuit unit 60 being inserted into the final mating position, the mating between the circuit unit 60 and electrical connector 70 is completed.

In the mating process of the circuit unit 60 and electrical connector 70, the locking of the first connector 62 and the second connector 80 is completed, as shown in FIGS. 30-31. After the mating of the first connector 62 and the second connector 80 is completed, the release of the locking of the second locking projections 82 of the second connector 80 by the first locking projections 76 is initiated by the first lock release projections 67 and second lock release projections 77, as shown in FIGS. 32-33, and completed, as shown in FIGS. 34-35. Accordingly, there is no half-mating of the first connector 62 with the second connector 80. In other words, when the circuit unit 60 is inserted into the final mating position shown in FIGS. 36-37, the mating of the first connector 62 and the second connector 80 has already been completed. Consequently, the electrical connector 70 is capable of reliably preventing half-mating between the first connector 62 and the second connector 80 that is accommodated inside the cover member 71. Moreover, when the mating between the circuit unit 60 and the electrical connector 70 is to be released, the circuit unit 60 is pulled in the direction opposite from the direction of arrow Y shown in FIGS. 25-26 from the state shown in FIGS. 36-37 to cause the circuit unit 60 to be retracted. As a result, an operation that is opposite from the operation shown in FIGS. 25-37 is performed, so that the mating between the circuit unit 60 and the electrical connector 70 is released, as shown in FIGS. 25-26.

The foregoing illustrates some of the possibilities for practicing the invention. Many other embodiments are possible within the scope and spirit of the invention. For example, the connector device 51 of the second embodiment may be further configured to have alignment apertures and alignment plates similar to the connector device 1 of the first embodiment to prevent erroneous mating. Moreover, in the electrical connector 70, when the circuit unit 60 is inserted into the final mating position shown in FIG. 36, the holding arms 91 enter into and lock in the opening members 92 formed in the side walls of the first connector housing 63, so that the circuit unit 60 is held in the cover member 71. However, it would also be possible to design the circuit unit 60 to be held in the cover member 71 when the circuit unit 60 is inserted into a position other than the final mating position. It is, therefore, intended that the foregoing description be regarded as illustrative rather than limiting, and that the scope of the invention is given by the appended claims together with their full range of equivalents.

What is claimed is:

1. A connector device, comprising:

a circuit unit including a first connector provided with a plurality of contacts, the circuit unit being moveable between a mating position and a final mating position;

an electrical connector including a cover member and a second connector provided with a plurality of contacts that is arranged in the cover member, the cover member having a first connector housing receiving recess that receives the first connector;

at least one locking projection that locks the second connector in the cover member when the circuit unit is in the mating position, the contacts of the first connector being electrically connected to the contacts of the second connector in the mating position; and at least one lock release projection that unlocks the second connector when the first connector is moved from the mating position toward the final mating position, the second connector being moveable relative to the cover member when the first connector is moved from the mating position to the final mating position, the second connector being locked in the cover member in the final mating position, the contacts of the first connector being electrically connected to the contacts of the second connector in the final mating position.

2. The connector device of claim 1, further comprising a locking member that locks the first connector to the second connector when the first connector is in the mating position.

3. The connector device of claim 1, wherein the locking projection is formed on the cover member.

4. The connector device of claim 1, wherein the second connector is moveable in a direction of insertion and removal of the circuit unit after the lock release projection unlocks the second connector.

5. The connector device of claim 1, wherein the first connector includes an alignment plate and the second connector includes an alignment aperture that align the first and second connector when the first and second connector are mated.

6. The connector device of claim 1, further comprising holding arms that secure the circuit unit in the cover member in the final mating position.

7. The connector device of claim 1, wherein the circuit unit has a varying width, the width of the circuit unit at a side of insertion into the cover member corresponding to a circuit unit receiving recessed member formed in the cover member.

8. The connector device of claim 1, wherein the first connector is arranged in a circuit unit housing and the cover member has a circuit unit housing receiving recess positioned adjacent to the first connector housing receiving recess that receives the circuit unit housing.

9. The connector device of claim 1, wherein the locking projection is formed on a cantilever latch arm.

10. The connector device of claim 1, wherein the locking projection prevents movement of the second connector away from a side of insertion of the circuit unit into the cover member.

11. The connector device of claim 1, wherein the cover member includes opposing support arms, the second connector being arranged between the support arms and secured thereby.

12. The connector device of claim 1, wherein the cover member includes stoppers that engage the second connector to prevent movement of the second connector toward a side of insertion of the circuit unit into the cover member.

* * * * *